US010145148B2

(12) United States Patent
Tremble et al.

(10) Patent No.: US 10,145,148 B2
(45) Date of Patent: Dec. 4, 2018

(54) DIRECT ACTION WINDOW LOCK

(71) Applicant: Milgard Manufacturing Incorporated, Tacoma, WA (US)

(72) Inventors: John Tremble, Redmond, WA (US); Gordon H. Liebel, Buckley, WA (US); Kevin D. Vilhauer, Puyallup, WA (US); Dan Blase, Everett, WA (US); R. Lee Rawls, Woodinville, WA (US); James A. Duncan, Renton, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 914 days.

(21) Appl. No.: 14/533,527

(22) Filed: Nov. 5, 2014

(65) Prior Publication Data

US 2015/0121765 A1 May 7, 2015

Related U.S. Application Data

(60) Continuation of application No. 13/457,788, filed on Apr. 27, 2012, now Pat. No. 8,899,632, which is a (Continued)

(51) Int. Cl.
*E05C 1/00* (2006.01)
*E05B 65/08* (2006.01)

(Continued)

(52) U.S. Cl.
CPC ..... *E05B 65/08* (2013.01); *E05B 5/003* (2013.01); *E05B 15/102* (2013.01); *E05B 41/00* (2013.01);

(Continued)

(58) Field of Classification Search
CPC ..... E05B 65/08; E05B 65/0864; E05B 5/003; E05B 15/102; E05B 41/00; E05B 63/00;

(Continued)

(56) References Cited

U.S. PATENT DOCUMENTS 151,529 A 6/1874 Baker
466,184 A 12/1891 Pumyea (Continued)

FOREIGN PATENT DOCUMENTS

GB 1035157 7/1966
GB 2405176 2/2005

(Continued)

OTHER PUBLICATIONS

Communication Pursuant to Article 94(3) EP, dated Sep. 8, 2011, 4 pages.

(Continued)

*Primary Examiner* — Alyson M Merlino
(74) *Attorney, Agent, or Firm* — Rathe Lindenbaum LLP

(57) ABSTRACT

A window latch for a sliding window having a sliding sash including a latch plate and a housing. The housing includes an engagement element movable relative to the housing from a locked position operatively engaged with the latch plate to an unlocked position disengaged from the latch plate. A handle is operatively coupled to the engagement element and movable from a first position to a second position in a first direction corresponding to the direction the sliding sash to which the handle is attached moves to an open position. The handle operatively moves the engagement element from the locked position to the unlocked position as the handle is moved in the first direction toward the second position.

22 Claims, 15 Drawing Sheets

Related U.S. Application Data division of application No. 11/521,086, filed on Sep. 14, 2006, now Pat. No. 8,182,001.

(51) Int. Cl.

| | |
|---|---|
| ***E05B 15/10*** | (2006.01) |
| ***E05B 41/00*** | (2006.01) |
| ***E05B 63/20*** | (2006.01) |
| ***E05C 1/12*** | (2006.01) |
| ***E05C 3/14*** | (2006.01) |
| ***E05B 5/02*** | (2006.01) |
| ***E05B 63/00*** | (2006.01) |
| ***E06B 3/42*** | (2006.01) |
| ***E06B 7/00*** | (2006.01) |

(52) U.S. Cl.

CPC ..... *E05B 63/00* (2013.01); *E05B 63/20* (2013.01); *E05B 65/0864* (2013.01); *E05C 1/12* (2013.01); *E05C 3/14* (2013.01); *E06B 3/42* (2013.01); *E06B 7/00* (2013.01); *E05B 2065/0805* (2013.01); *Y10T 292/0834* (2015.04); *Y10T 292/0836* (2015.04); *Y10T 292/0999* (2015.04); *Y10T 292/1014* (2015.04)

(58) Field of Classification Search

CPC .... E05B 63/20; E05B 2065/0805; E05C 1/12; E05C 3/14; E06B 3/42; E06B 7/00

See application file for complete search history.

(56) References Cited

U.S. PATENT DOCUMENTS

| | | | |
|---|---|---|---|
| 939,480 | A | 11/1909 | Deggim |
| 1,058,584 | A | 4/1913 | Hendricks |
| 1,280,993 | A | 10/1918 | Hammer |
| 1,654,221 | A | 12/1927 | Kline |
| 1,728,276 | A | 9/1929 | Hoyt |
| 2,140,890 | A | 12/1938 | Waitekaites |
| 2,217,248 | A | 10/1940 | Ferruggia |
| 2,503,370 | A | 4/1950 | Zanona |
| 2,560,274 | A | 7/1951 | Cantello |
| 2,600,483 | A | 6/1952 | Colonna |
| 2,802,682 | A | 8/1957 | Enckevort |
| 2,950,137 | A | 8/1960 | Check |
| 3,082,617 | A | 3/1963 | Kerman |
| 3,222,098 | A | 12/1965 | Hausfeld |
| 3,939,529 | A | 2/1976 | Davis |
| 3,984,136 | A | 10/1976 | Bills |
| 4,102,012 | A | 7/1978 | Davis |
| 4,226,002 | A | 10/1980 | Davis |
| 4,259,811 | A | 4/1981 | Davis |
| 4,441,835 | A | 4/1984 | Davis |
| 4,555,829 | A | 12/1985 | Davis |
| 4,582,435 | A | 4/1986 | Davis |
| 4,699,406 | A | 10/1987 | Swanson, Jr. |
| 4,826,222 | A | 5/1989 | Davis |
| 4,968,072 | A | 11/1990 | Taylor et al. |
| 5,090,754 | A | 2/1992 | Thompson |
| 5,139,291 | A | 8/1992 | Schultz |
| 5,193,249 | A | 3/1993 | Bucher |
| 5,210,908 | A | 5/1993 | Bucher |
| 5,244,238 | A | 9/1993 | Lindqvist |
| 5,326,141 | A | 7/1994 | Gorman |
| 5,331,766 | A | 7/1994 | Bennett |
| 5,450,654 | A | 9/1995 | Sullivan |
| 5,509,177 | A | 4/1996 | Hindin et al. |
| D373,316 | S | 9/1996 | Walters |
| D373,998 | S | 9/1996 | Tutt et al. |
| D374,394 | S | 10/1996 | Lynch et al. |
| D376,098 | S | 12/1996 | Bucher |
| 5,669,639 | A | 9/1997 | Lawrence |
| D384,880 | S | 10/1997 | Harvey et al. |
| D392,182 | S | 3/1998 | Taylor et al. |
| D395,222 | S | 6/1998 | Fountaine |
| 5,791,805 | A | 8/1998 | Lynch et al. |
| 5,829,199 | A | 11/1998 | Harvey et al. |
| 5,901,501 | A | 5/1999 | Fountaine |
| 5,937,582 | A | 8/1999 | Taylor |
| 5,951,068 | A | 9/1999 | Strong et al. |
| 5,975,598 | A | 11/1999 | Fischer |
| 6,098,340 | A | 8/2000 | Francis |
| 6,138,325 | A | 10/2000 | Figliola et al. |
| D442,464 | S | 5/2001 | Richardson |
| D448,647 | S | 10/2001 | Goldsbury |
| 6,314,681 | B1 | 11/2001 | Moody |
| D452,130 | S | 12/2001 | Richardson |
| D459,208 | S | 6/2002 | Figliola |
| 6,412,834 | B1 | 7/2002 | Waitai et al. |
| 6,450,063 | B1 | 9/2002 | Harvey et al. |
| D470,389 | S | 2/2003 | Richardson |
| 6,598,910 | B2 | 7/2003 | McGregor et al. |
| D483,649 | S | 12/2003 | Linford et al. |
| 6,669,242 | B2 | 12/2003 | Fountaine et al. |
| 6,764,115 | B1 | 7/2004 | Speed et al. |
| D495,237 | S | 8/2004 | Tozer |
| D495,582 | S | 9/2004 | Richardson et al. |
| 6,827,376 | B2 | 12/2004 | Fountaine |
| 6,846,025 | B2 | 1/2005 | Sclater et al. |
| 6,848,728 | B2 | 2/2005 | Rotondi et al. |
| D508,195 | S | 8/2005 | Pack et al. |
| 6,952,916 | B1 | 10/2005 | Fountaine |
| 7,165,791 | B2 | 1/2007 | Rebel et al. |
| 7,407,199 | B2 | 8/2008 | Richardson |
| 2002/0195824 | A1 | 12/2002 | Fountaine et al. |
| 2002/0195826 | A1 | 12/2002 | Fountaine |
| 2003/0168867 | A1 | 9/2003 | Sclater et al. |
| 2004/0195843 | A1 | 10/2004 | Rotondi et al. |
| 2004/0201227 | A1 | 10/2004 | Smith |
| 2005/0140150 | A1 | 6/2005 | Hall et al. |
| 2006/0033343 | A1 | 2/2006 | Xu |
| 2006/0244269 | A1 | 11/2006 | Rotondi |
| 2008/0012357 | A1 | 1/2008 | Liang et al. |
| 2008/0179896 | A1 | 7/2008 | Chung |
| 2008/0211238 | A1 | 9/2008 | Stevens |
| 2009/0241609 | A1 | 10/2009 | Laporta |

FOREIGN PATENT DOCUMENTS

| | | | |
|---|---|---|---|
| WO | 2004038141 | A1 | 5/2004 |
| WO | 2008033702 | A1 | 3/2008 |

OTHER PUBLICATIONS

Instituto Mexicano De La Propiedad Industrial, Official Action, dated Oct. 17, 2011 for Application No. MX/a/2009/001817, 4 pages.

DIRECT ACTION WINDOW LOCK

CROSS-REFERENCE TO RELATED PATENT APPLICATIONS

This application is a continuation of U.S. patent application Ser. No. 13/457,788, filed Apr. 27, 2012, which is a divisional of U.S. patent application Ser. No. 11/521,086 filed Sep. 14, 2006, now U.S. Pat. No. 8,182,001, issued May 22, 2012, both entitled "DIRECT ACTION WINDOW LOCK", which are hereby incorporated by reference in their entirety.

BACKGROUND OF THE INVENTION

The present invention relates generally to the field of window locks, and more particularly to an improved self locking window latch for a sliding window. A window latch secures a window sash when it is in the closed. In sliding windows, where a window sash is slid relative to another sash, the latch is first released in order to slide the window to the open position. When the window is slid back to its closed position, the latch is used to lock the window in place. If the latch is not moved to the locked position, the window may be opened by simply sliding the window to the open position permitting unwanted entry. An automatically locking mechanism helps to ensure that the window sash is properly locked when the window is slid to the closed position. One such locking mechanism is disclosed in U.S. Pat. No. 5,901,501. The latch described in the '501 patent includes a handle that is in an upwardly pointing direction, the locking mechanism is released by depressing the handle downwardly, the window sash is then slid in a direction opposite to the first direction that the handle is depressed. Once the window sash is slid open the handle disclosed in the '501 patent the handle returns to the upward position.

It would be desirable to provide an automatically locking mechanism where the handle is moved in the same direction that window sash slides when moving the window sash to the open position. Further it would be desirable for the handle to have a first position when the window sash is locked and a second perceptually visible different position when the window sash is not locked. It would also be desirable for the engagement elements to be retained in an unlocked position while the window sash is open and automatically move to the locked position when the window sash is closed. Further it would be desirable to achieve the noted features while providing a secure lock.

SUMMARY OF THE INVENTION

One embodiment of the invention relates to a window latch for a sliding window having a sliding sash including a latch plate and a housing. The housing includes an engagement element movable relative to the housing from a locked position operatively engaged with the latch plate to an unlocked position disengaged from the latch plate. A handle is operatively coupled to the engagement element and movable from a first position to a second position in a first direction corresponding to the direction the sliding sash to which the handle is attached moves to an open position. The handle operatively moves the engagement element from the locked position to the unlocked position as the handle is moved in the first direction toward the second position.

In another embodiment a window latch for a sliding sash window includes a handle movable between a first position and a second position. An engagement member is movable between an extended locked position and a retracted unlocked position. The engagement element is biased toward the extended locked position by a spring element. A stop member is movable from an engaged position in which the stop member retains the engagement element in the retracted unlocked position to a disengaged position in which the engagement element is free to move to the extended locked position. A latch plate is configured to receive the engagement element in the extended locked position and a strike member configured to contact a portion of the stop member. The stop member being moved to the disengaged position when the stop member contacts the strike member, and being biased to the engaged position when the stop member does not contact the strike member.

In still another embodiment a window latch for a sliding window includes a first sash movable between a closed position and an open position along a first direction, a handle movable in the first direction from a first lowered position to a second raised position. An engagement element is releasably movable from an extended locked position to a retracted unlocked position. The handle is operatively held in the second raised position by a spring element when the first sash is in the open position and the engagement element is in the retracted unlocked position.

In yet another embodiment a sliding window includes a first sash slidable relative to a second sash. A latch is operatively attached to the first sash and a latch plate is operatively attached to the second sash. The latch includes a engagement element that extends from the first sash and is received in an opening in the second sash to lock the first and second sash together. A handle pivots from a first lowered position proximate the first sash to a second raised direction where a free end of the handle is away from the first sash in the same direction that the first sash moves when the first sash is opened relative to the second sash. The handle retracts the engagement element from the second sash unlocking the first and second sash as the handle is moved toward the second position.

Additionally, the handle may be held in at least a partially raised position relative to the first sash when then the first sash is open and the engagement element is in the retracted unlocked position. The handle being automatically returned to the first lowered position when the first sash is closed and the engagement elements are biased to the locked position. Further, the engagement element may automatically be returned to the extended locked position when the first sash is moved to the closed position.

In still a further embodiment, a method of unlocking and locking a sliding window having a first and second sash includes securing a latch to the first sash and a latch plate to the second sash. The latch includes a handle, and an engagement element. Unlocking the engagement element from the latch plate by moving the handle in the same direction that the first sash moves to the open position relative to the second sash. Retaining the handle in a raised position by a spring element while the first sash is in the open position and the engagement element is in the unlocked position. Moving the first sash toward the closed position and automatically releasing and biasing the engagement element into the locked position and automatically moving the handle to the lowered position when the engagement element is in the locked position.

DETAILED DESCRIPTION OF THE PREFERRED EMBODIMENTS

Figure 1:
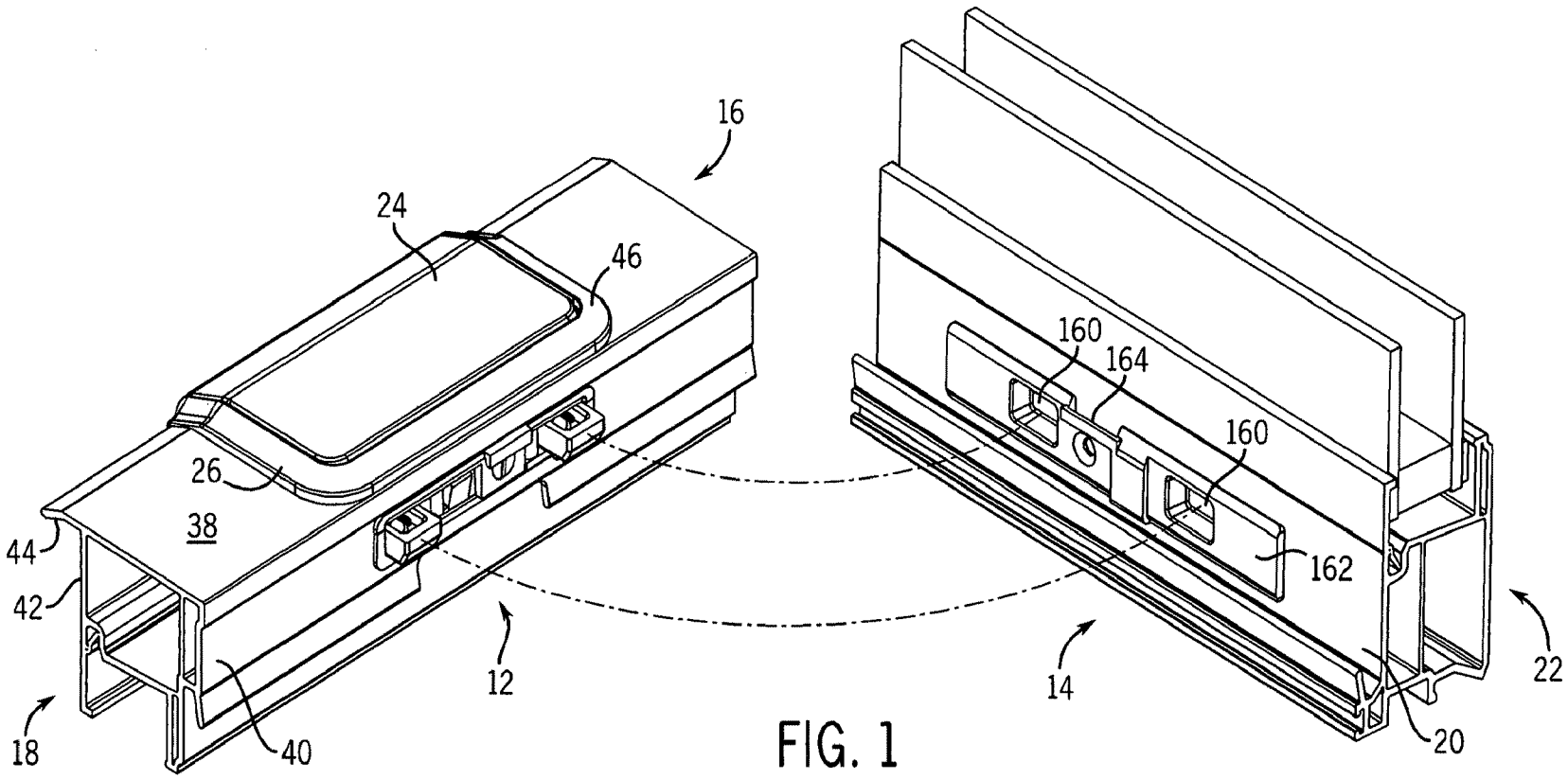
FIG. 1 is an isometric partially exploded view of a latch and latch plate on respective sashes.
Figure 2:
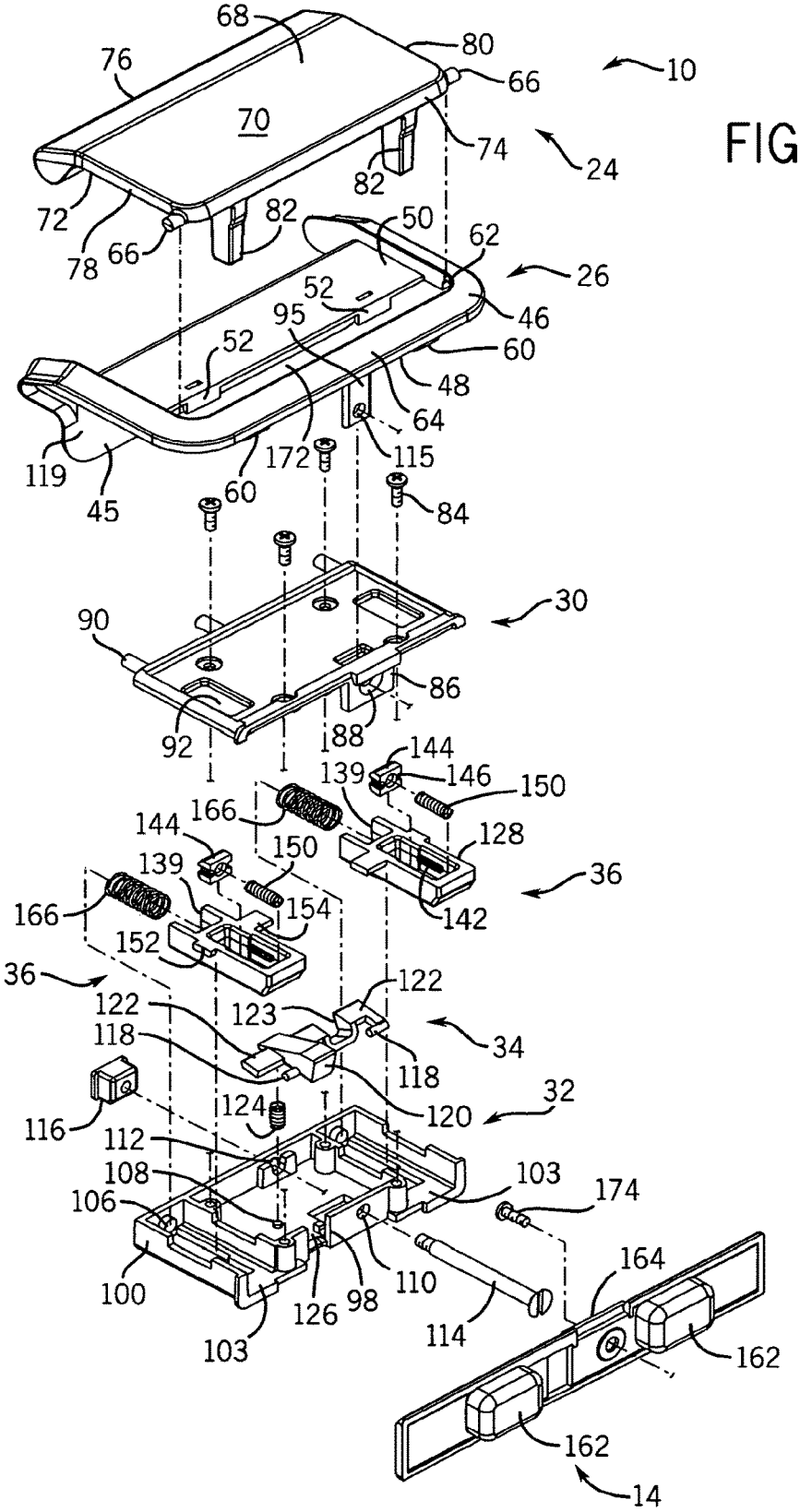
FIG. 2 is an exploded view of the latch and latch plate of FIG. 1.

Referring to FIGS. 1 and 2, a latch mechanism 10 includes a latch 12 and a latch plate 14. Latch 12 is located in a recess in a first rail 16 of a first or moving sash 18. Latch plate 14 is secured to a second rail 20 of a second sash 22. Latch 12 includes a handle 24 that is pivotally attached to a handle faceplate or bezel frame 26. A latch housing 28 includes a cover plate 30 and a base 32. Two bolt assemblies 36 are independently slidably positioned within base 32 between a first extended locked position to a second retracted unlocked position. A lockout stop or lockout assembly 34 is pivotally attached to base 32 to retain handle 24 in a partially raised position when latch 10 is moved away from the latch plate 14 and sash 18 is in an open position relative to sash 22.

The latch mechanism 10 may be used on a sliding window including horizontal sliding windows and vertical sliding windows. A horizontal sliding window is often referred to as a horizontal slider while a vertical sliding window is often referred to as a single hung or double hung window. While the latch mechanism 10 may be used with different types of sliding windows including those identified above, latch mechanism 10 will be described relative to a vertical sliding window. Accordingly, the direction "up" or "upper" is used to reference a general vector direction away from the force of gravity or the direction first sash 18 moves as it is opened relative to second sash 22. The term "rear" is used to describe the surface of the first sash that is proximate to or closer to the second sash. While the term "front" is used to describe the surface that a person would see facing the window from inside of a building structure. The term "rail" as used in the description describes the horizontal rail on the sash. However, when latch mechanism 10 is used on a horizontal sliding window the term stile would be more appropriate. In the case of a horizontal sliding window, the term "up" would be the direction the first sash moves as the first sash is being opened relative to the second sash.

Latch mechanism 10 provides an easy and intuitive operation to open a window sash 18. A user simply raises handle 24 in an upward direction thereby unlocking the bolt assemblies 36 from the latch plate 14 and moves the first sash 18 in an upward direction. As described below in the preferred embodiment handle 24 is pivotally coupled to the window sash, however, the general direction that the handle moves is in an upward direction. Accordingly, as used herein the movement of the handle is referred to as moving in a first direction that corresponds to the vector direction of the movable sash in the window. As first sash 18 is opened relative to second sash 22, the lockout assembly 34 keeps bolt assemblies 36 in a partially retracted unlocked position. The partial retraction of bolt assemblies 36 prevents possible damage to the window frame, glass or applied mounting bars. Handle 24 remains in a partially raised position without the assistance of the user when first sash 18 is not in the fully closed position and latch mechanism 10 is not positively locked. When the user returns first sash 18 to a closed position, lockout assembly 34 is tripped and allows bolt assemblies 36 to automatically extend into the apertures 160 of latch plate 14 thereby positively locking first sash 18 and second sash 22 together. Handle 24 automatically returns to a flush downward position providing a visual indicator that latch mechanism 10 is positively locked.

Figure 4:
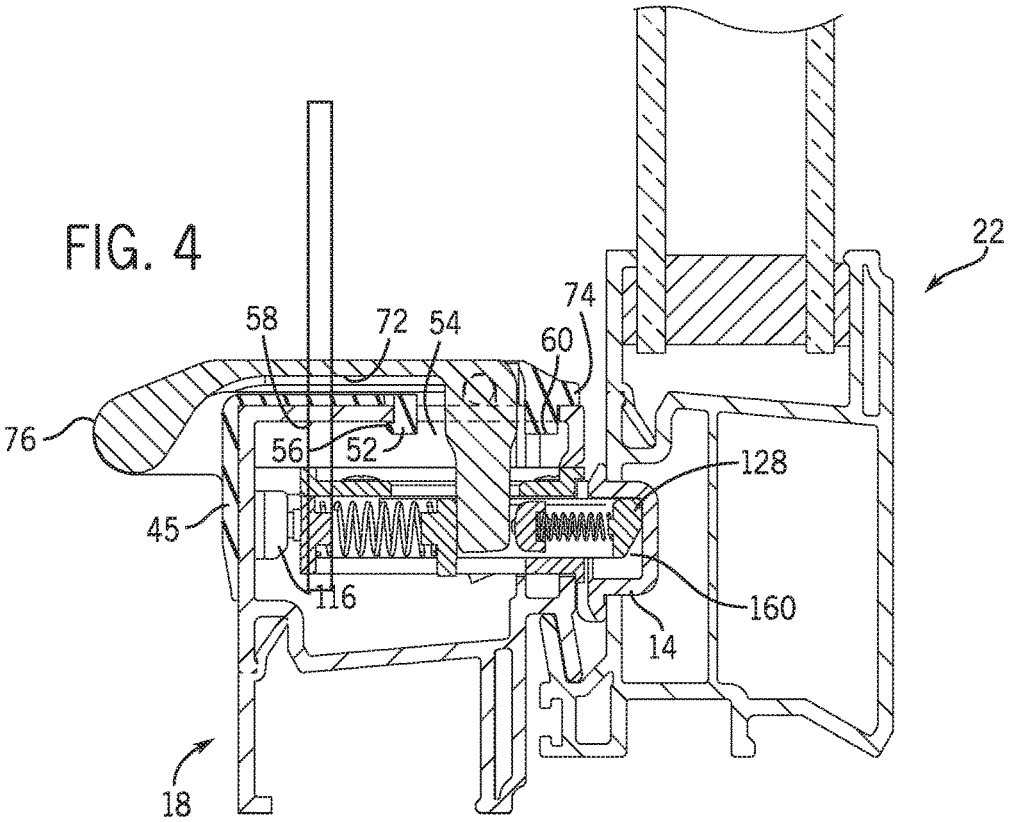
FIG. 4 is a cross-sectional view of the latch and latch plate in a locked position taken along lines 4-4 of FIG. 3

Referring to FIGS. 1, 2 and 4, first rail 16 includes a top surface 38, a first downwardly extending portion 40 and a second downwardly extending portion 42. A ledge 44 extends from top surface 38 beyond second downwardly extending surface 42. Ledge 44 provides a user with an area to grab first rail 16 when sliding first sash 18 relative to second sash 22. Bezel frame 26 includes a top surface 46 and an opposing bottom surface 48 that contacts the top surface 38 and ledge 44. Bezel frame also includes a downwardly extending portion 45 that contacts and covers a portion of downwardly extending portion 42 of first rail 16. Bezel frame 26 further includes a top land region 50 that includes downwardly extending tabs 52 that extend into aperture 54 in the top surface 38 of first rail 16. Tabs 52 may also include an inward extending catch 56 that is configured to clip under an opposing bottom surface 58 of top surface 38 of first rail 16. Bezel frame 26 further includes a second set of tabs 60 that extend downwardly into aperture 54. Tabs 52 and 60 positively secure and help secure bezel frame 26 to first rail 16. Bezel frame 26 further includes two apertures, recesses or bearings 62 proximate a rear portion 64 of bezel frame 26 to receive two pivot pins 66 of handle 24.

Handle 24 includes a top plate 68 having a top surface 70, a bottom surface 72, a rear edge 74 and a front edge 76. Pivot pins 66 extend from respective sides 78, 80 of top plate 68 proximate rear edge 74. A pair of arms 82 extend downwardly from the bottom surface 72 of top plate 68 to retract the sliding bolt assemblies 36. Referring to FIG. 2 the top surface 70 of top plate 68 is substantially flush with the top surface 46 of bezel frame 26. This provides for a low profile of the handle 24 relative to the top surface 38 of first rail 16. That is the top surface of 70 of top plate 68 is raised only a small distance above the top surface of first rail 16. Further the top surface 70 is substantially parallel to the top surface of first rail 16. In a preferred embodiment, the top surface 70 of top plate 68 is 0.125 inches above the top surface 38 of first rail 16. It would be preferable if the top surface 70 of top plate 68 were no greater than 0.250 inches above the top surface 38 of first rail 16. However other distances such as 0.200 inches are acceptable as well. It is possible for the handle to be completely flush with the top surface of first rail 16 as well. This could be accomplished if the top surface of first rail 16 included an opening or recess sufficient to accommodate the thickness of the top plate of handle 24.

Figure 3:
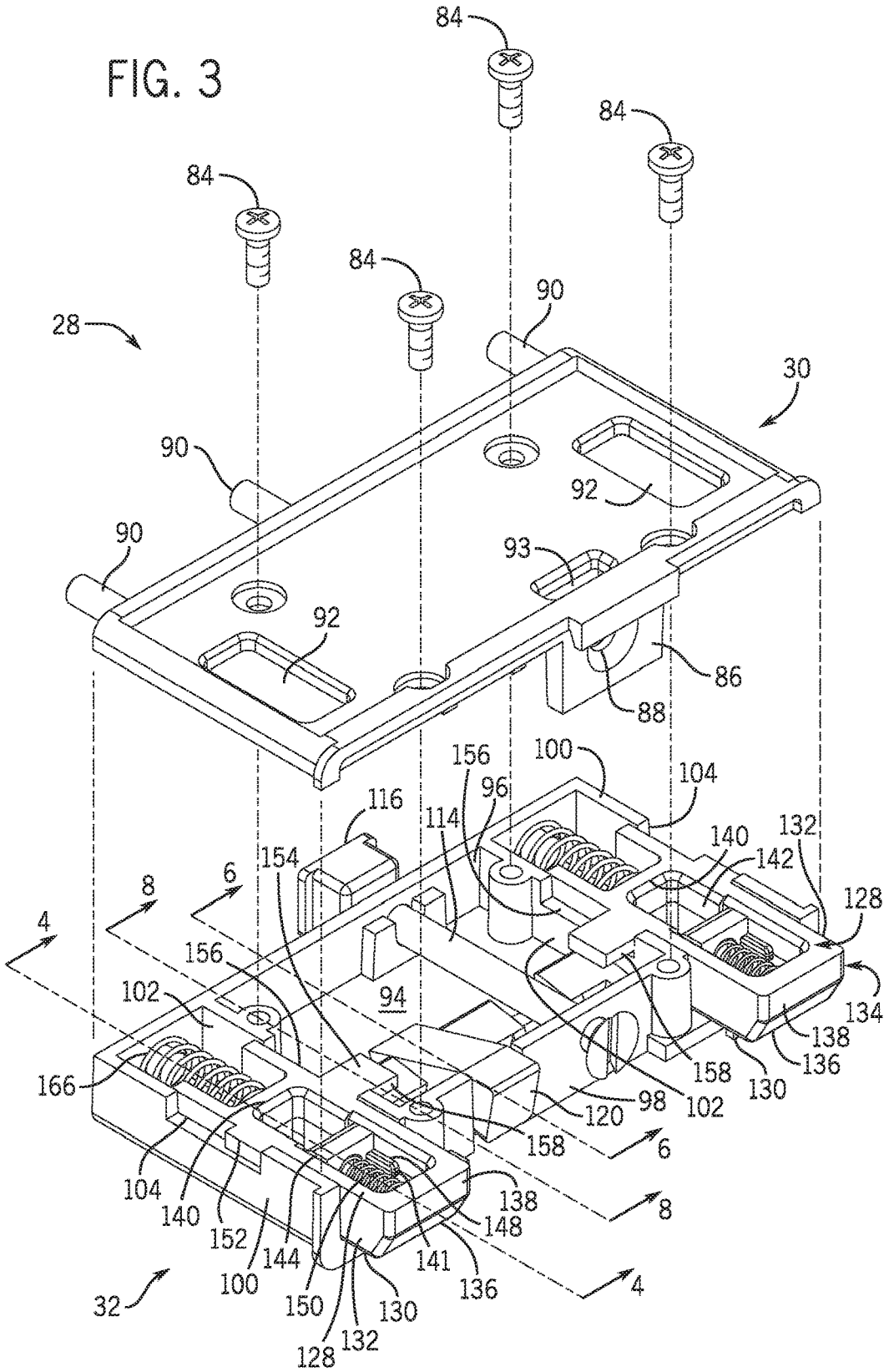
FIG. 3 is partial exploded view of the latch of FIG. 1.

Referring to FIGS. 2 and 3 cover plate 30 is secured to base 32 with fasteners 84. Cover plate 30 is further secured to base 32 with a downwardly extending flange 86 having an aperture 88 extending therethrough. Cover plate 30 includes three locator pins 90 for positioning the latch housing within first rail 16. Locating pins 90 may be received in an aperture of first rail 16 or other connecting feature to positively locate the cover 30 relative to rail 16. Cover plate 30 also includes two apertures 92 through which arms 82 of handle 24 extend. An aperture 93 is situated proximate flange 86 to receive a downwardly extending flange 95 of bezel frame 26.

Base 32 includes a bottom panel 94 a front wall 96, a rear wall 98 and a pair of side walls 100. Extending upward from bottom panel 94 and substantially parallel to the side walls 100 are channel side walls 102. A bolt slide channel 103 is formed between each pair of side walls 100 and 102. Each side wall 100 includes a notch 104 located on an upper edge thereof. Extending from a rear side of front wall 96 in each of bolt slide channel 103 is a post 106 configured to received a bolt spring 166. Another post 108 configured to receive a pawl spring 124 extends upwardly from the bottom panel 94 intermediate the channel side walls 102. Rear wall 98 includes an aperture 110 and front wall 96 includes an aligned aperture 112. A fastener 114 extends through aperture 110 in cover plate 30, aperture 115 in bezel frame 26, aperture 110 in base rear wall 98, aperture 112 in base front wall 96 and into a nut 116. Nut 116 is secured to a downwardly extending portion 45 of bezel frame 26. Nut 116 extends from bezel frame 26 through an opening in rail 16. In a preferred embodiment, nut 116 is operatively connected to bezel frame 26 with a tongue and groove arrangement. In this manner the components are secured to one another.

Referring to FIG. 2 lockout assembly 34 includes a pair of pivot pins 118 that are supported in two bearings (not shown) defined by cover 30 and base 32. Lockout assembly 34 includes a cam pawl 120 and a pair of ramps 122. A u-shaped portion 123 permits lockout assembly 34 to pivot within base 32 without interference with fastener 114. A pawl spring 124 is located on post 108 and operatively contacts a bottom portion of cam pawl 120. Cam pawl 120 includes a strike portion that extends through an opening 126 in the rear wall 98 of base 32.

Referring to FIGS. 2 and 3 each bolt assembly 36 includes an engagement element or bolt housing 128 having a bottom surface 130 that slides along the bottom panel 94 of base 32. Bolt housing 128 further includes a pair of upstanding walls 132 and a rear portion 134 having a first beveled strike surface 136 and a second upper surface 138. Bolt housing includes a bolt spring receiving channel 139 formed by side walls 132 and a cross wall 140 extending therebetween a fixed distance from the ends of the front edge of walls 130, 132. A handle arm receiving channel 142 is formed between cross wall 140 and the rear portion 134. A shuttle 144 having at least one groove 146 slides on a tongue 148 extending inwardly on side walls 132. A handle spring 150 extends between rear portion 134 and shuttle 144 to bias the shuttle 144 into the handle arm receiving channel 142. Bolt housing 128 further includes a first tab 152 extending through notch 104 and a second locking tab 154 extending through a notch 156 in each side wall 132. Second locking tab 154 includes a rear edge surface 158.

Referring to FIGS. 1 and 2, latch plate 14 includes a pair of apertures 160 extending inward from a front surface 162. A striker 164 is located intermediate apertures 160 and extends outward from front surface 162 in a direction away from apertures 160.

Latch mechanism 10 is installed on the first and second sashes. Handle 24 is located within bezel frame 26 by bringing the leading or front edge 76 through opening 172 of bezel frame 26. Handle pivots 66 are seated within pivot bearing or groove 62 in bezel frame 26. Latch 12 is assembled by first connecting lockout assembly 34 by connecting pivots 118 on a supporting groove or bearing portion on base 32. A lock spring 124 is located on post 108 and extends upwardly toward pawl 120. Bolt housings 128 are placed within a respective bolt housing channel 103. A bolt spring 166 is located over each post 106 and fit between front wall 96 and a center wall 140 of bolt housing 128. A handle spring 150 is located within bolt housing 128 between rear wall 141 and a movable shuttle 144. Cover plate 30 is secured to base 32 with a plurality of fasteners 84. Of course a single fastener or other known fasteners may be used to secure the cover to the base. The cover 30 and base 32 are located within an opening region in rail 16 by fitting three locator pins 90 within three respective recesses in rail 16.

Bezel frame 26 and handle 24 are snapped onto a routed opening in first rail 16 of first sash 18. A downwardly extending flange or tab 95 is located within opening 93 in cover 30. A fastener or bolt 114 is thread through aperture 88 in flange 86 of cover 30, through opening 115 in tab 95 of bezel frame 26, opening 110 in rear wall 98 of base 32, through opening 112 in front wall 96 of base 32 and finally into a nut 116 that is operatively connected to an inside surface 119 of downwardly extending portion 45 of bezel frame 26. In this manner access to the latch mechanism is only through the rear surface of the movable sash 18 that faces second sash 22. Latch plate 14 is secured to second sash 22 with a fastener 174.

Figure 5:
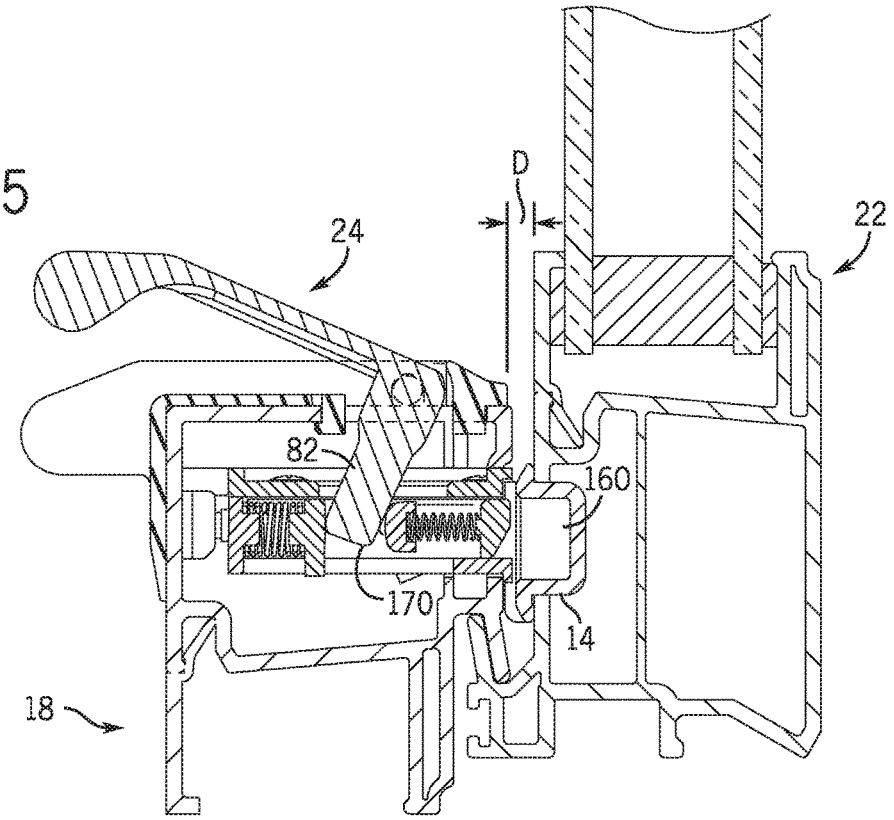
FIG. 5 is a cross-sectional view of the latch and latch plate of FIG. 4 in an unlocked position.
Figure 6:
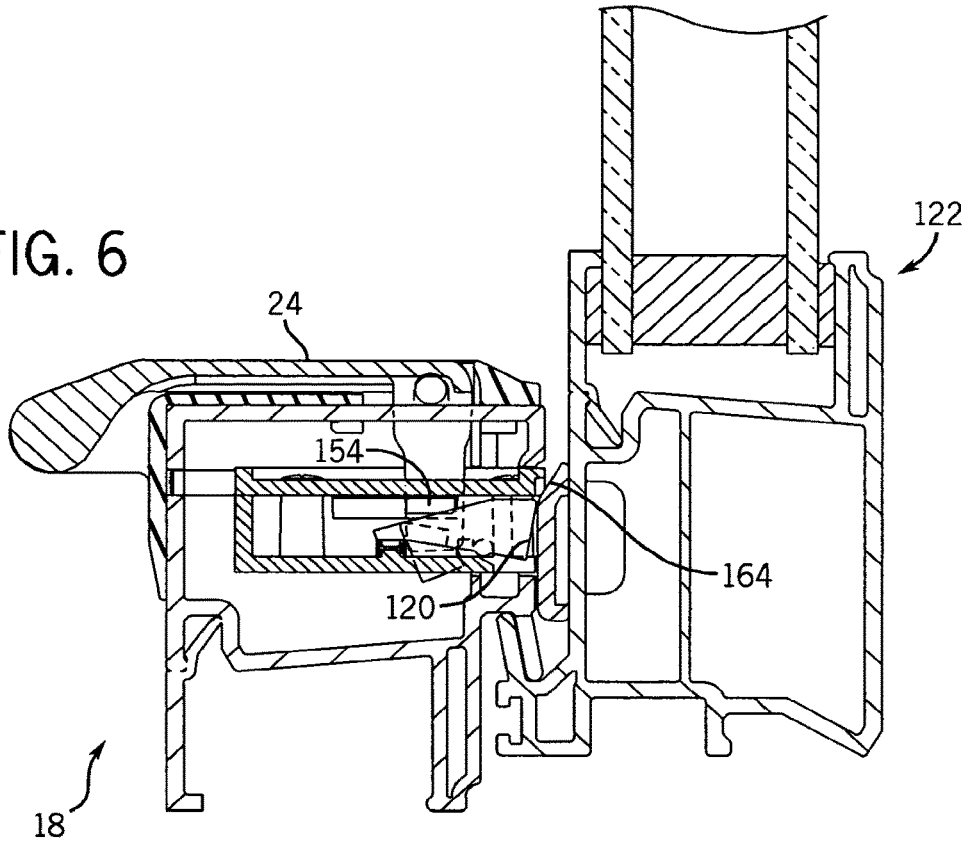
FIG. 6 is a cross-sectional view of the fully assembled latch and latch plate with the latch in a locked position showing the actuator pawl taken generally along lines 6-6 of FIG. 3.
Figure 7:
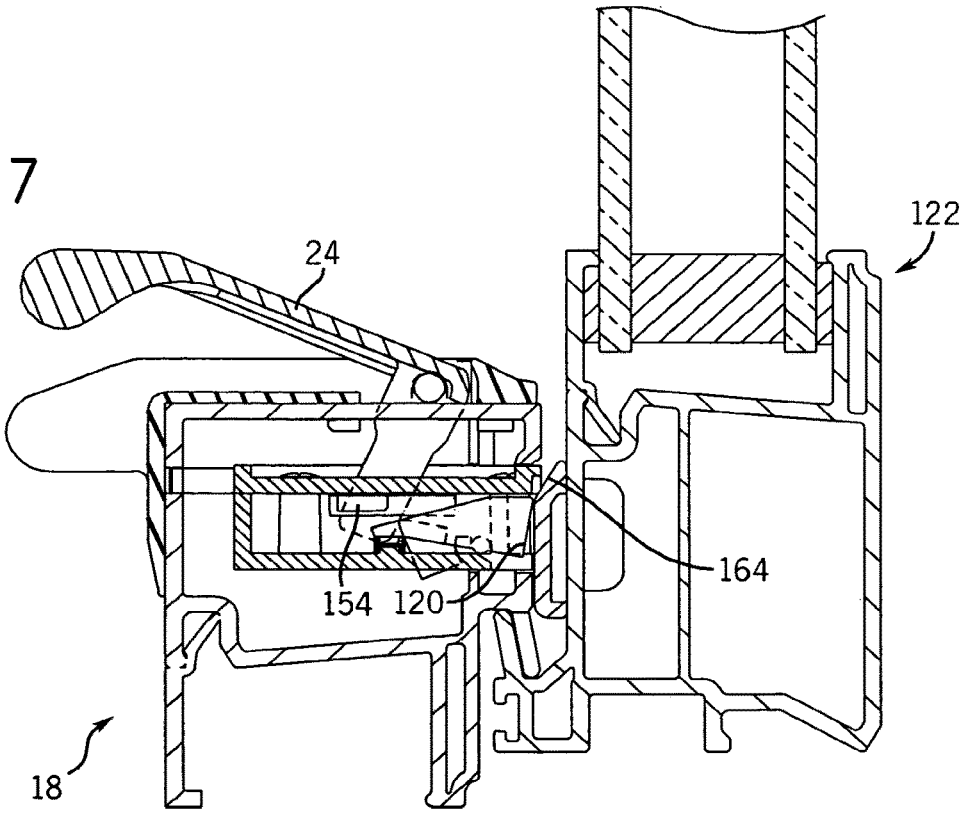
FIG. 7 is a cross-sectional view of the latch and latch plate of FIG. 6 showing the actuator pawl taken generally along lines 6-6 of FIG. 3 when the latch is in the unlocked position.
Figure 8:
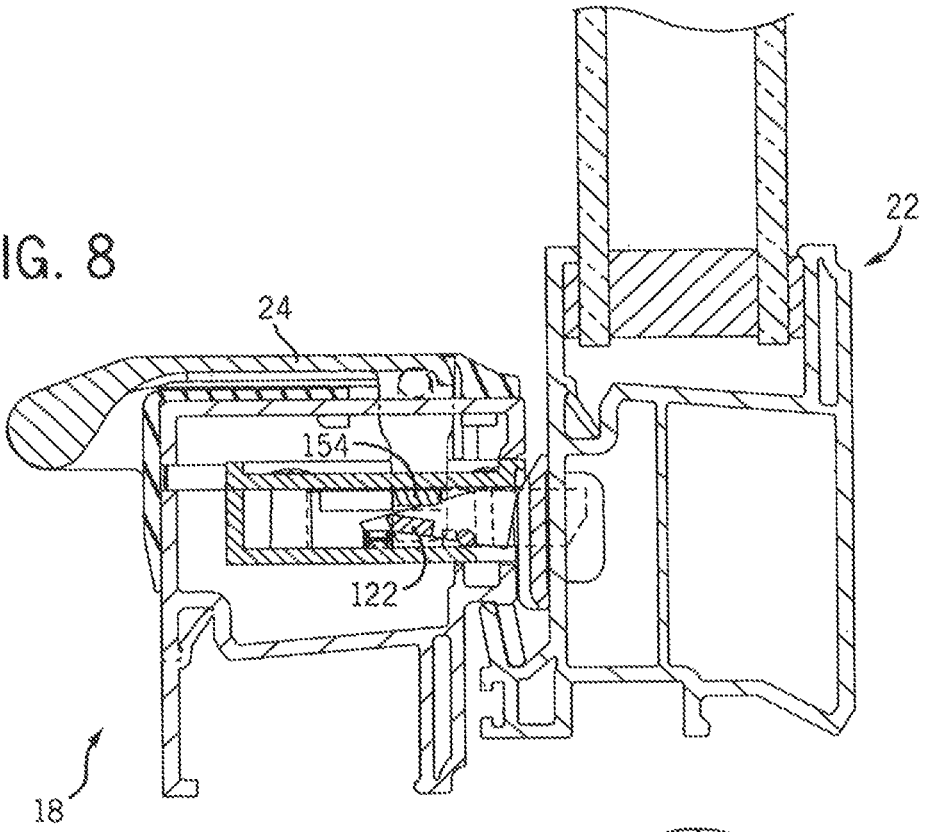
FIG. 8 is a cross-sectional view of the fully assembled latch and latch plate with the latch in a locked position showing the actuator pawl and lockout tab taken generally along lines 8-8 of FIG. 3.

Referring to FIGS. 4-11 the operation of latch 10 will be described. Handle 24, bolt assemblies 36, and lockout assembly 34 interact in the operation of the latch to releasably lock first and second sashes 18, 22 together. Referring to FIGS. 4, 6 and 8 handle 24, bolt assemblies 36 and lockout assembly are in a fully engaged and locked position. In the locked position the rear portion 134 of bolts 36 are located within respective apertures 160 in latch plate 14. As a result first sash 18 is locked relative to second sash 22. Bolt spring 166 is secured to post 106 and extends between front wall 96 of base 32 and intermediate wall 140 of bolt housing 128. Bolt spring 166 acts to bias bolt housing 128 away from front wall 96 such that the rear portion 134 of the bolt housing extends into apertures 160 of latch plate 14.

Referring to FIG. 6, in the locked position cam pawl 120 is adjacent the front surface 162 of latch plate 14. As a result the front portion of cam pawl 120 presses against pawl spring 124. Referring to FIG. 8, in the locked position, ramps 122 are located below lock tabs 154 and therefore do not interfere with movement of bolt housing 128.

To unlock the latch a front edge or 76 of handle 24 is raised away from first rail 16. Referring to FIG. 5 as handle 24 is raised, arms 82 contact center wall 140 of bolt housing 128 forcing bolt housing 128 toward front wall 96 of base 32. As a result rear portion 134 of bolt housing 218 is retracted from apertures 160. As arm 82 is pivoted toward the front of base 32, handle spring 150 biases shuttle 144 against the rear face 170 of arm 82. When bolt housing 128 is retracted, latch mechanism 10 is unlocked. However, as long as first sash 18 is in a closed position relative to second sash 22, such that bolt assemblies 36 are in alignment with apertures 160, bolt springs 166 will bias bolt housings 128 into the locked position when a user releases handle 24.

Figure 9:
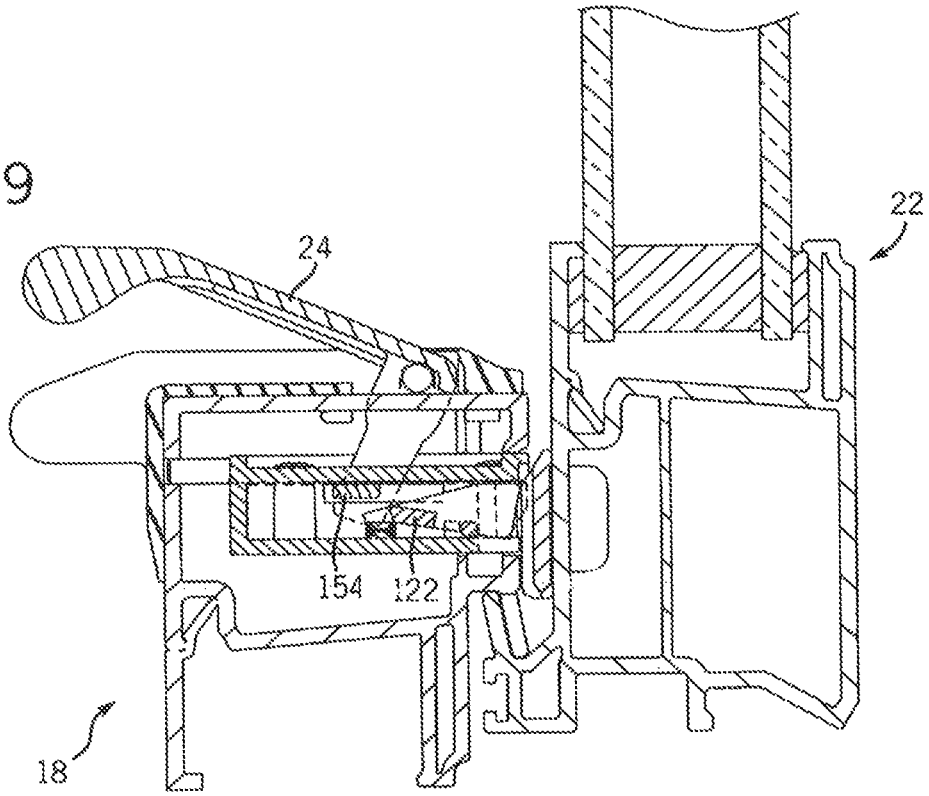
FIG. 9 is a cross-sectional view of the fully assembled latch and latch plate of FIG. 8 showing the actuator pawl and lockout tab when the latch is in the unlocked position.
Figure 10:
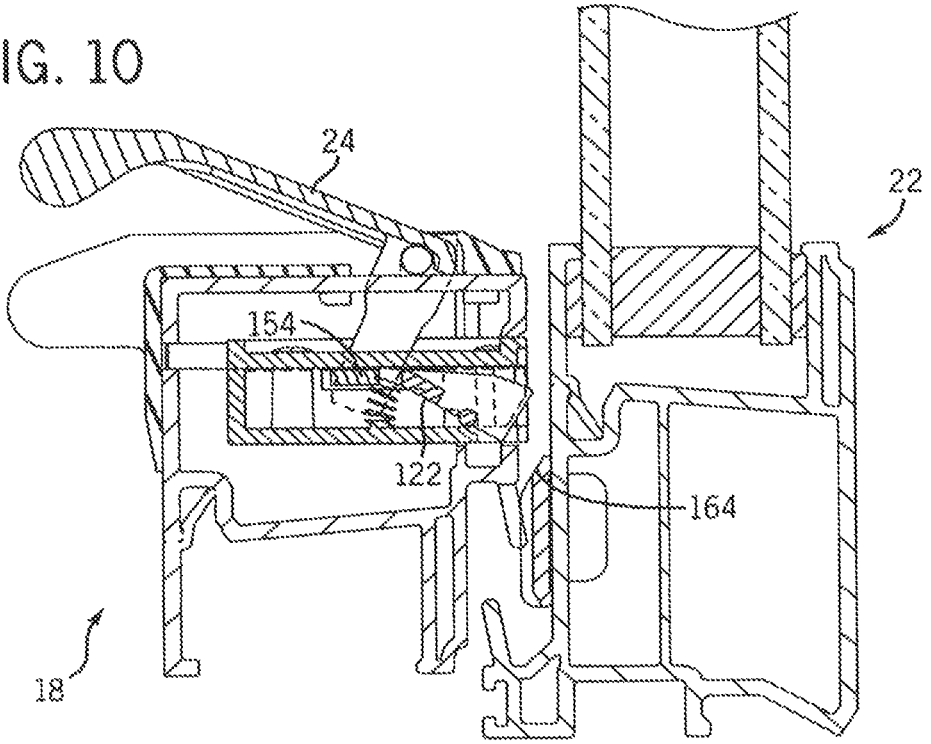
FIG. 10 is a cross-sectional view of the fully assembled latch and latch plate of FIG. 8 showing the actuator pawl and lockout tab when the sash is in an open position and the latch is moved away from the latch plate.

Referring to FIGS. 7 and 9, as long as first sash 18 remains fully closed relative to second sash 22, when a user releases handle 24 it will return to the locked position where top surface 70 of handle 24 is substantially flush with top surface 46 of bezel frame 26. Since the spring force of bolt spring 166 is greater than the spring force of handle spring 150, when handle 24 is released by the user while in the unlocked and closed position then handle 24 will return to being flush with bezel frame 26. Once handle 24 is released while sashes 18 and 22 are in a closed position, latch 12 will lock. Referring to FIG. 10, once a user has raised handle 24, thereby unlocking latch 12, and moves first sash 18 upward toward an open position, pawl 120 clears latch plate 14. Once pawl 120 clears latch plate 14, pawl 120 will be biased about pivot 118 by pawl spring 124. In this position, ramps 122 extend upward and fall within the path of lock tab 154 of bolt housing 128, prohibiting bolt housing 128 from being biased toward a fully extended and locked position.

Figure 11:
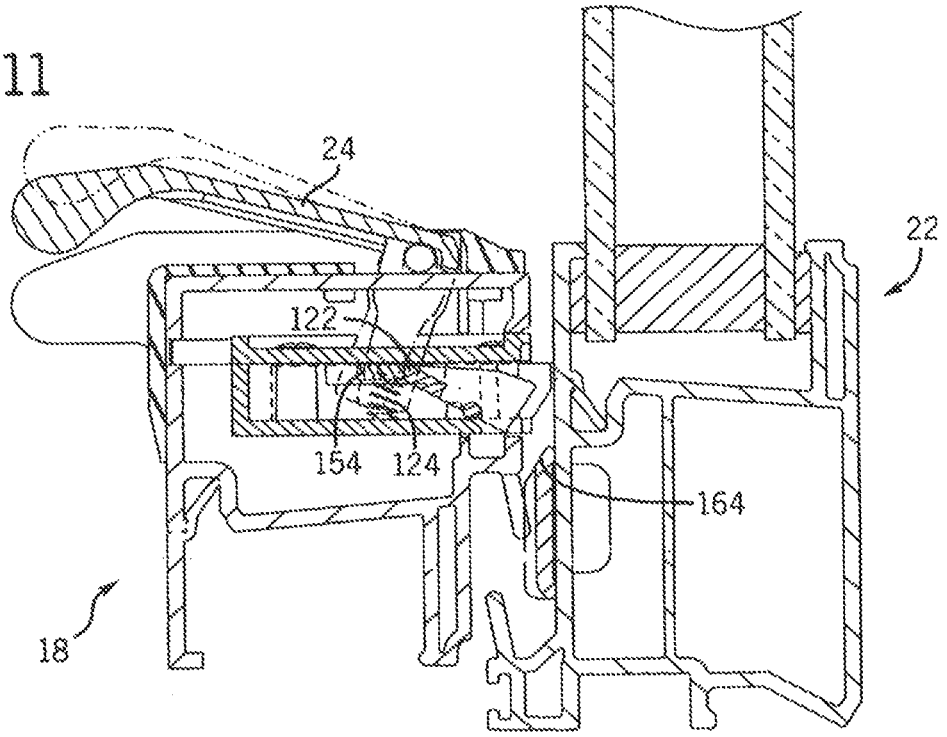
FIG. 11 is a cross-sectional view of the fully assembled latch and latch plate of FIG. 8 showing the actuator pawl and lockout tab when the sash is in the open position and the handle is in a partially raised position.

Referring to FIG. 11, as handle 24 is released, bolt housing 128 moves rearward under the spring force of bolt spring 166. Bolt housing 128 moves rearward until lock tab 154 is stopped by ramp 122. When first sash 18 is open and handle 24 is released, rear portion 134 of bolt housing 128 may extend beyond rear wall 98 of base 32. It is also possible to design the location of ramps 122 to prohibit bolt housing 128 from extending beyond rear wall 98. However, if bolt housing 128 does extend beyond rear wall 98, second strike face 138 of rear portion 134 does not extend beyond a clearance distance D between first sash 18 and second sash 22. In this open and released position, handle 24 is closer to top surface 38 of first rail 16 than when handle 24 is fully raised. Handle 24 does not fall back completely within bezel frame 26 under its own weight as a result of the spring force of handle spring 150 pushing against the handle. In this open and released position, handle 24 remains partially raised when the first sash 18 is open relative to the second sash 22. A user may force handle 24 to its lowered position when the window is open and the unlocked by providing sufficient force to overcome the spring force of spring 150. However, upon release of the force by the user, handle 24 will return to the at least partially raised position under the spring force of spring 150. This assures that even if a user inadvertently attempts to force handle 24 to the lowered position while window sash 18 is opened, bolt housings 128 will not move to the engaged position and handle 24 will return to the at least partially raised position to provide a visual indicator that the window is not locked.

When a user closes the window by sliding first sash 18 back to the closed position, the top leading edge of pawl 120 contacts strike portion 164 of latch plate 14. As a result, lockout assembly 34 rotates about pivots 118 releasing ramp 122 from the back edge of lock tab 154. Once lock tab 154 is no longer constrained by ramp 122 of lockout assembly 34, bolt housing 128 is biased rearward by bolt spring 166. Bolt housing 128 is biased rearward such that the rear portion 134 of bolt housing 128 is located within apertures 160 of latch plate 14. As bolt housing 128 is moved rearward, handle 24 is biased to the closed flush position by center wall 140 thereby indicating that the latch is in a locked configuration. If the bolt housing does not properly align with apertures 160 of latch plate 14, a rear portion 134 of each bolt housing 128 includes a beveled portion 136 that will contact latch plate 14 as first sash 18 is being moved to a closed position relative to second sash 22. As beveled portion 136 contacts latch plate 14, bolt housing 128 is slid toward the front of the base 32 until rear portion 134 of bolt housing 128 clears front surface 162 and enters into aperture 160 of latch plate 14. In the preferred embodiment, lockout assembly 34 does not release bolt housings 128 until rear portion 134 of bolt housings 128 are aligned with apertures 160.

Each bolt housing 128 slides independently of the other bolt housing 128. While a single lockout assembly 34 locks both bolt housings 128 in the open and unlocked position, once the lockout assembly 34 disengages with the bolt housing lock tabs 154, each bolt housing 128 moves independently. This independent motion limits potential jams of the bolts within the housing. Even if one bolt housing 128 becomes jammed or stuck, the other bolt housing 128 can slide to the fully locked position thereby locking the first sash 18 relative to the second sash 22. Further the linear motion of the bolt housing 128 helps to reduce possible jamming of bolt housings 128 within the latch mechanism.

Figure 12:
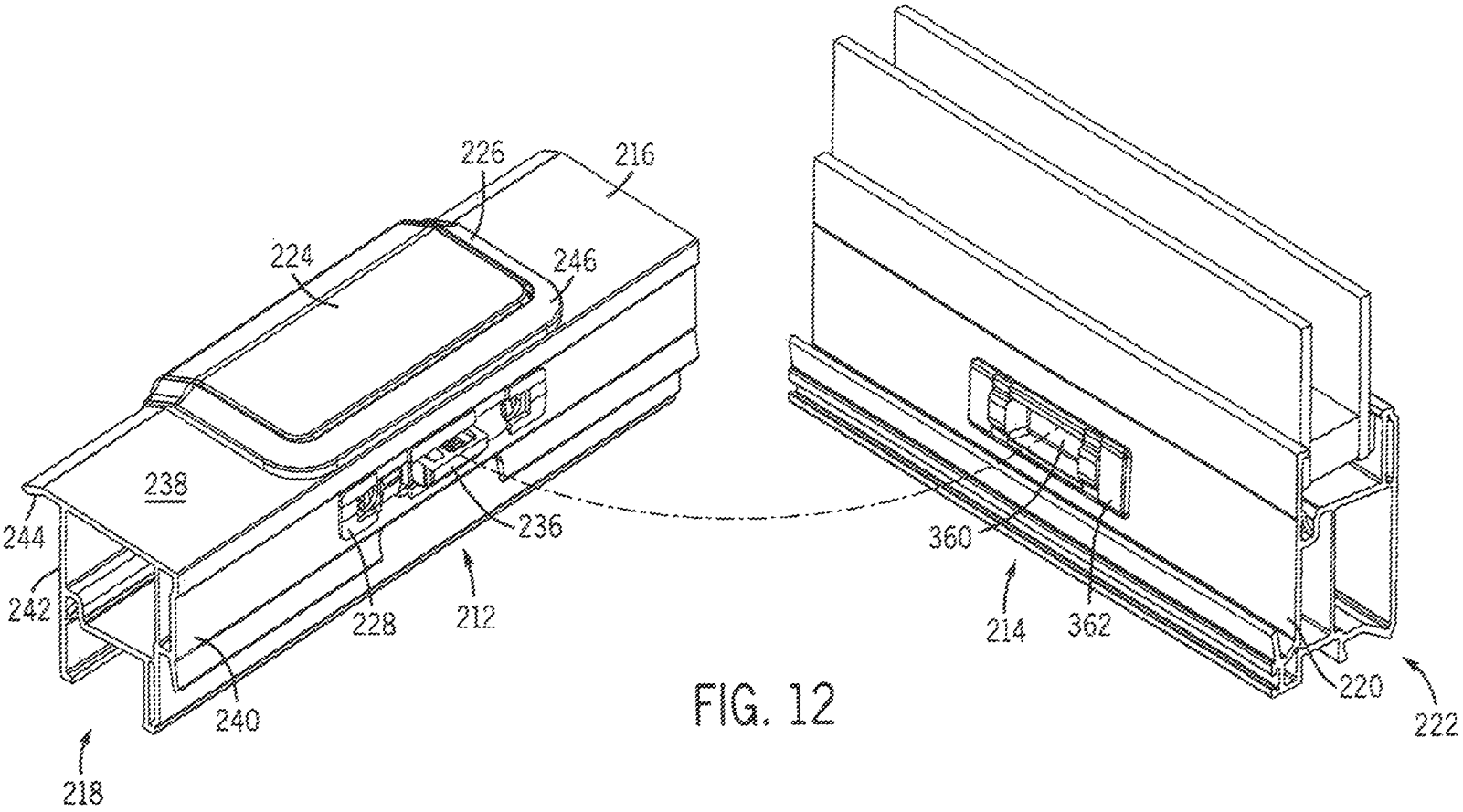
FIG. 12 is an isometric partially exploded view of a latch and latch plate on respective sashes according to another exemplary embodiment.
Figure 13:
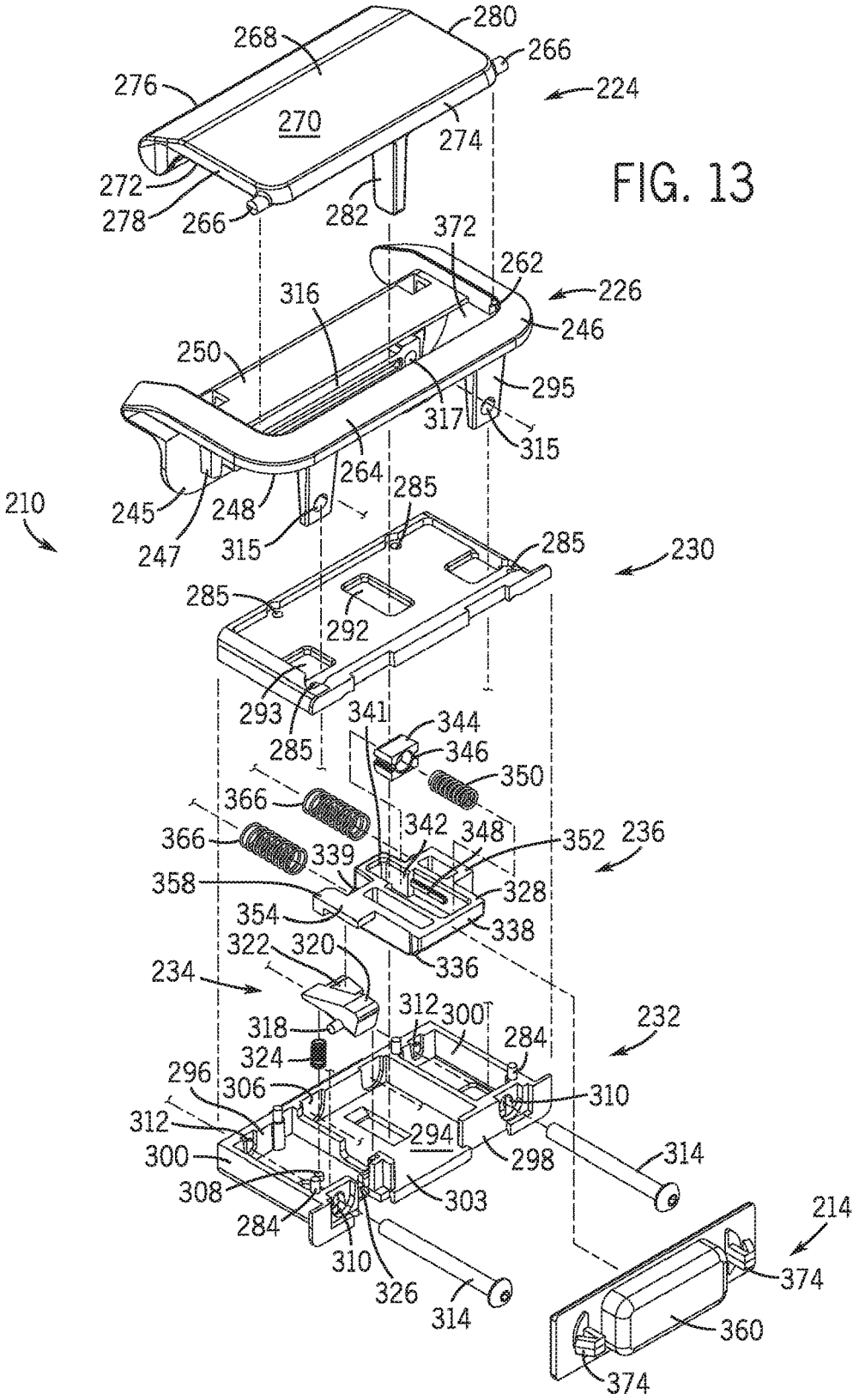
FIG. 13 is an exploded view of the latch and latch plate of FIG. 12.

Referring to FIGS. 12 and 13, a latch mechanism 210 is shown according to another exemplary embodiment. Latch mechanism 210 includes a latch 212 and a striker plate or latch plate 214. Latch 212 is located in a recess in a first rail 216 of a first or moving sash 218. Latch plate 214 is secured to a second rail 220 of a second sash 222 and includes an recessed area or aperture 360 extending inward from a front surface 362. Latch 212 includes a handle 224 that is pivotally attached to a handle faceplate or bezel frame 226, a latch housing 228, a bolt assembly 236, and a lockout assembly 234. Latch housing 228 includes a cover plate 230 and a base 232. Bolt assembly 236 is slidably positioned within base 232 between a first extended locked position to a second retracted unlocked position. Lockout stop or lockout assembly 234 is pivotally attached to base 232 to retain handle 224 in a partially raised position when latch 210 is moved away from the latch plate 214 and sash 218 is in an open position relative to sash 222.

Figure 15:
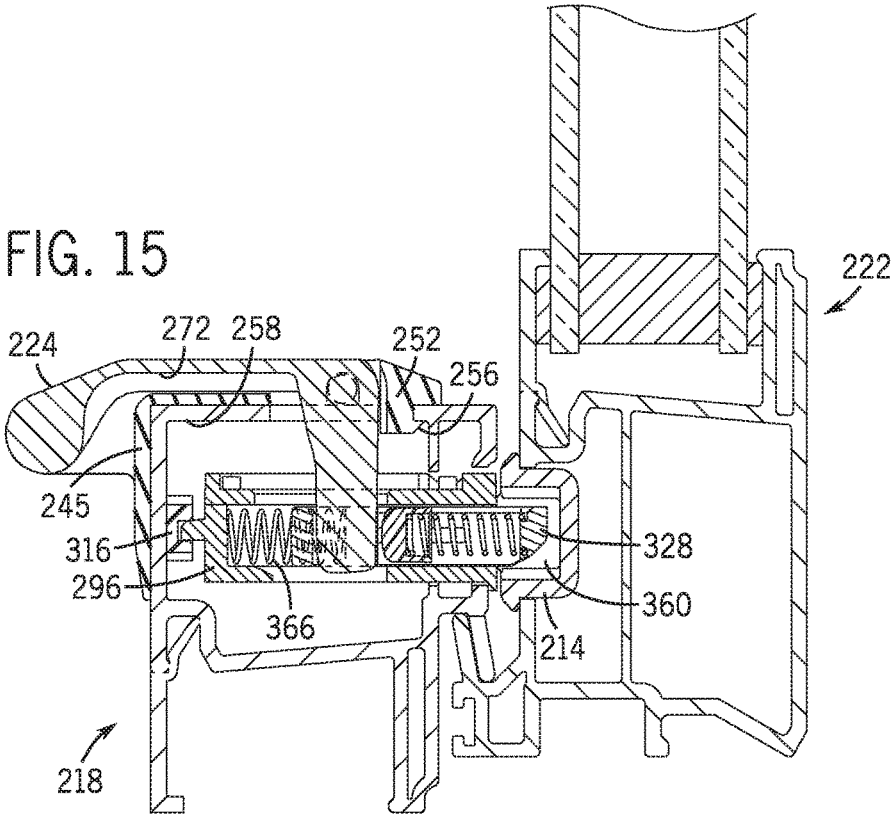
FIG. 15 is a cross-sectional view of the latch and latch plate in a locked position taken along lines 15-15 of FIG. 14

Referring to FIGS. 12, 13 and 15, first rail 216 includes a top surface 238, a first downwardly extending portion 240 and a second downwardly extending portion 242. A ledge 244 extends from top surface 238 beyond second downwardly extending surface 242. Ledge 244 provides a user with an area to grab first rail 216 when sliding first sash 218 relative to second sash 222.

Bezel frame 226 includes a top surface 246 and an opposing bottom surface 248 that contacts the top surface 238 and ledge 244 of first rail 216. Bezel frame 226 also includes a downwardly extending portion 245 that contacts and covers a portion of downwardly extending portion 242 of first rail 216, a top land region 250 generally perpendicular to downwardly extending portion 245, and a rear portion 264 generally opposite of downwardly extending portion 245. Downwardly extending portion 245 has coupling features, shown as two generally L-shaped brackets or flanges 247 that are configured to receive a fastener bar 316. Rear portion 264 includes a downwardly extending tab or protrusion 252 that may form an inward extending catch 256 that is configured to clip under an opposing bottom surface 258 of top surface 238 of first rail 216. Tab 252 helps positively secure bezel frame 226 to first rail 216. Bezel frame 226 further includes two tabs or flanges 295 that extend downward from bottom surface 248 that are configured to receive fasteners 314 in apertures 315. Bezel frame 226 further includes two apertures, recesses or bearings 262 proximate a rear portion 264 of bezel frame 226 to receive two pivot pins 266 of handle 224.

Handle 224 includes a top plate 268 having a top surface 270, a bottom surface 272, a rear edge 274 and a front edge 276. Pivot pins 266 extend from respective sides 278, 280 of top plate 268 proximate rear edge 274. An arm 282 extends downwardly from the bottom surface 272 of top plate 268 to retract sliding bolt assembly 236. Referring to FIG. 13 top surface 270 of top plate 268 is substantially flush with the top surface 246 of bezel frame 226. This provides for a low profile of handle 224 relative to top surface 238 of first rail 216. That is top surface of 270 of top plate 268 is raised only a small distance above top surface 238 of first rail 216. Further top surface 270 is substantially parallel to top surface 238 of first rail 216. In a preferred embodiment, top surface 270 of top plate 268 is 0.125 inches above top surface 238 of first rail 216. It would be preferable if top surface 270 of top plate 268 were no greater than 0.250 inches above top surface 238 of first rail 216. It is possible for the handle to be completely flush with the top surface of first rail 216 as well. This could be accomplished if the top surface of first rail 216 included an opening or recess sufficient to accommodate the thickness of the top plate of handle 224.

Figure 14:
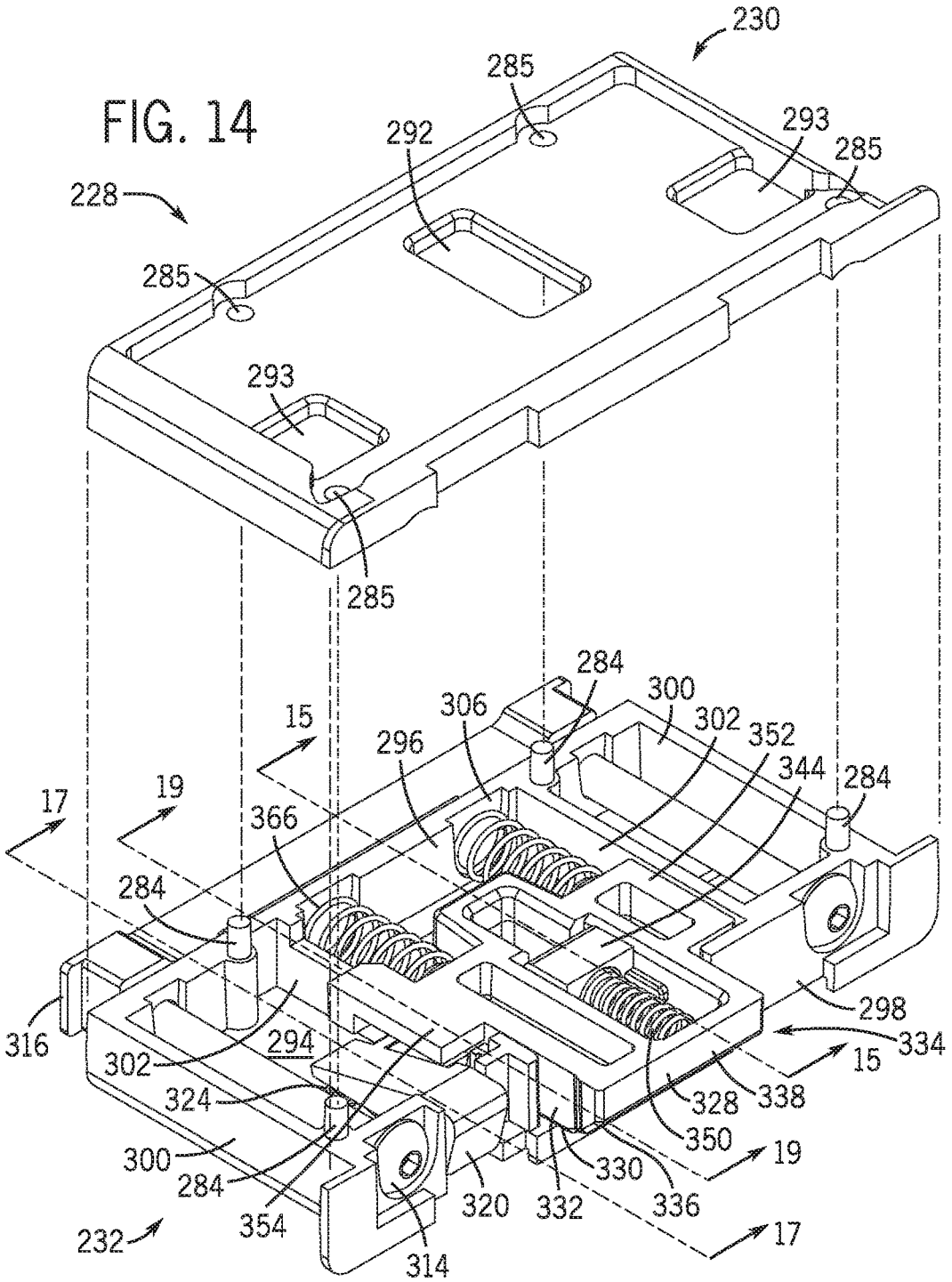
FIG. 14 is partial exploded view of the latch of FIG. 12.

Referring to FIGS. 13 and 14 cover plate 230 is secured to base 232 with fasteners. Cover plate 230 includes an aperture 292 through which arm 282 of handle 224 extends and two apertures 293 through which flanges 295 of bezel frame 226 extend. Cover plate 230 further includes a plurality of apertures 285 (e.g., depressions, holes, hollows, sockets, etc.) that extend partially or completely through cover plate 230 and are configures to receive posts 284 on base 232.

Base 232 includes a bottom panel 294 a front wall 296, a rear wall 298 and a pair of side walls 300. Extending upward from bottom panel 294 and substantially parallel to the side walls 300 are channel side walls 302. A bolt slide channel or bolt housing channel 303 is formed between side walls 302. Rear wall 298 forms an opening 326 that is configured to allow lockout assembly 234 to protrude outside base 232. Rear side of front wall 296 includes two depressions or recessed areas 306 in bolt slide channel 303 that are configured to received bolt springs 366. A post 308 configured to receive a pawl spring 324 extends upwardly from bottom panel 294 between one of side walls 300 and one of side walls 302.

Base further includes a plurality of posts 284 (e.g., pegs, protrusions, outcroppings, etc.) that extend upward from base 232. Posts 284 are configured to be received by corresponding apertures 285 in cover plate 230 and substantially align cover plate 230 with base 232. Rear wall 298 includes an aperture 310 and front wall 196 includes an aligned aperture 312. A fastener 314 extends through aperture 310 in base rear wall 298, aperture 315 in bezel frame 226, aperture 312 in base front wall 296 and into apertures 317 in fastener bar 316. Fastener bar 316 is received by brackets 247 in downwardly extending portion 245 of bezel frame 226. In a preferred embodiment, fastener bar 316 is operatively connected to base 232 with a tongue and groove arrangement and fasteners are coupled to apertures 317 (e.g., with a threaded connection). In this manner the components are secured to one another.

Referring to FIG. 13 lockout assembly 234 includes a pivot pin 318 that is supported in a bearing (not shown) defined by cover 230 and base 232. Lockout assembly 234 further includes a cam pawl 320 and a ramp 322. A pawl spring 324 is located on post 308 and operatively contacts a bottom portion of cam pawl 320. Cam pawl 320 includes a strike portion that extends through opening 326 in the rear wall 298 of base 232.

Referring to FIGS. 13 and 14 bolt assembly 236 includes an engagement element or bolt housing 328, bolt springs 366, a shuttle 344, and a handle spring 350. Bolt housing 328 has a bottom surface 330 that slides along the bottom panel 294 of base 232. Bolt housing 328 further includes a pair of upstanding walls 332 and a rear portion 334 having a first beveled strike surface 336 and a second upper surface 338. Bolt housing 328 further includes two posts 339 that are configured to receive bolt springs 366. Bolt springs 366 bias bolt housing 328 towards rear wall 298 so that rear portion 334 protrudes through rear wall 298. A stop portion 352 extends outward from bolt housing 328 and contacts the front surface of rear wall 298 to retain bolt housing 328 in bolt slide channel 303. Bolt housing 328 further includes a tab 354 having a rear edge surface 358 that extends outward from bolt housing 328 opposite of stop portion 352.

A channel 342 is formed in bolt housing 328 with a rear wall 341 and is configured to receive arm 282 of handle 268, shuttle 344, and handle spring 350. Channel 342 includes at least one inwardly projecting tongue 348. Shuttle 344 has at least one groove 346 and slides on tongue 348 in channel 342. Handle spring 350 extends between rear portion 334 and shuttle 344 to bias shuttle 344 into channel 342.

Latch mechanism 210 is installed on the first and second sashes 218, 222. Handle 224 is located within bezel frame 226 by bringing the leading or front edge 276 through opening 372 of bezel frame 226. Handle pivots 266 are seated within pivot bearing or groove 262 in bezel frame 226. Latch 212 is assembled by first connecting lockout assembly 234 by connecting pivots 318 on a supporting groove or bearing portion on base 232. A lock spring 324 is located on post 308 and extends upwardly toward pawl 320. Bolt housing 328 is placed within bolt housing channel 303. Bolt springs 366 are located in each depression 306 and fit between front wall 296 and posts 339 on bolt housing 328. A handle spring 350 is located within bolt housing 328 between rear wall 341 and a movable shuttle 344. Cover plate 230 is secured to base 232 by fitting posts 284 into apertures 285. Of course the cover plate may be coupled to the base by other suitable means (e.g., screws or other fasteners, glue, snap-fit connections, etc.). Bezel frame 226 and handle 224 are snapped onto a routed opening in first rail 216 of first sash 218. Fasteners or bolts 314 are thread through apertures 310, 315, and 312 and into apertures 317 of fastener bar 316 that is operatively connected to downwardly extending portion 245 of bezel frame 226. In this manner access to the latch mechanism is only through the rear surface of the movable sash 218 that faces second sash 222. Striker plate 214 is secured to second sash 222 with fastening features 374.

Figure 16:
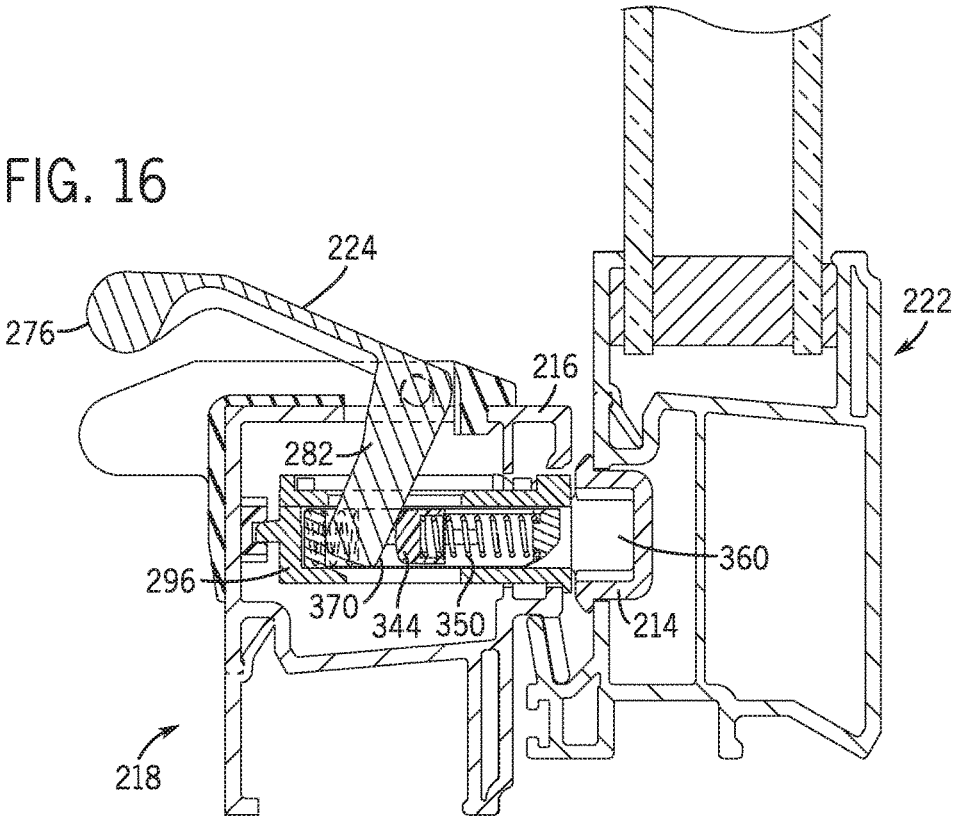
FIG. 16 is a cross-sectional view of the latch and latch plate of FIG. 15 in an unlocked position.
Figure 17:
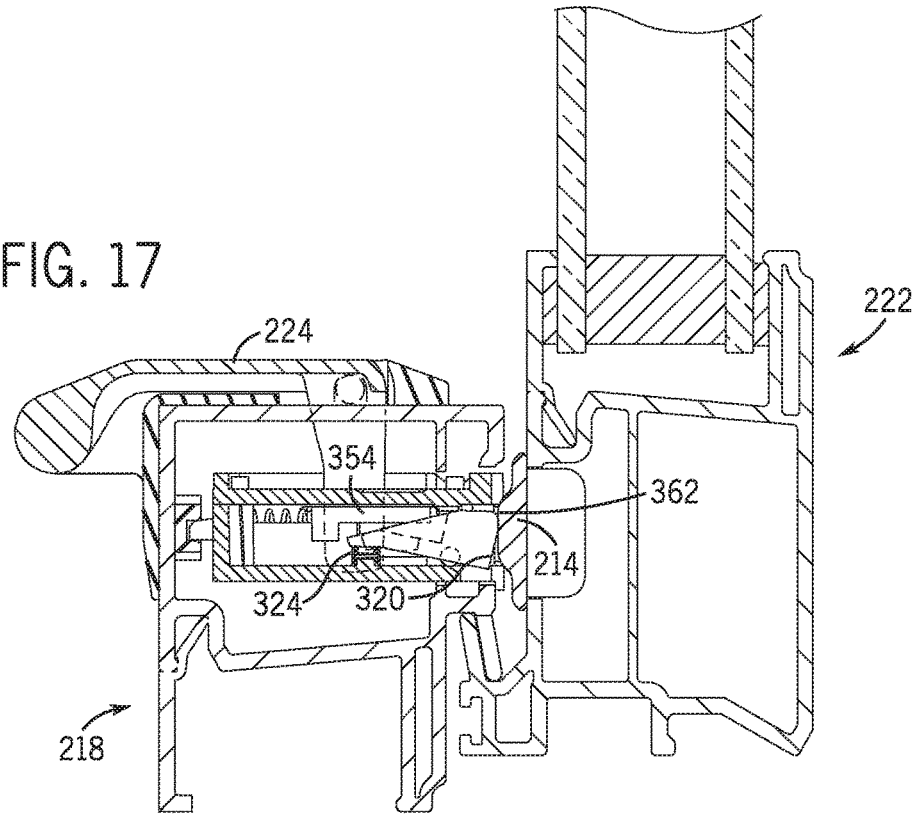
FIG. 17 is a cross-sectional view of the fully assembled latch and latch plate with the latch in a locked position showing the actuator pawl taken generally along lines 17-17 of FIG. 14.
Figure 18:
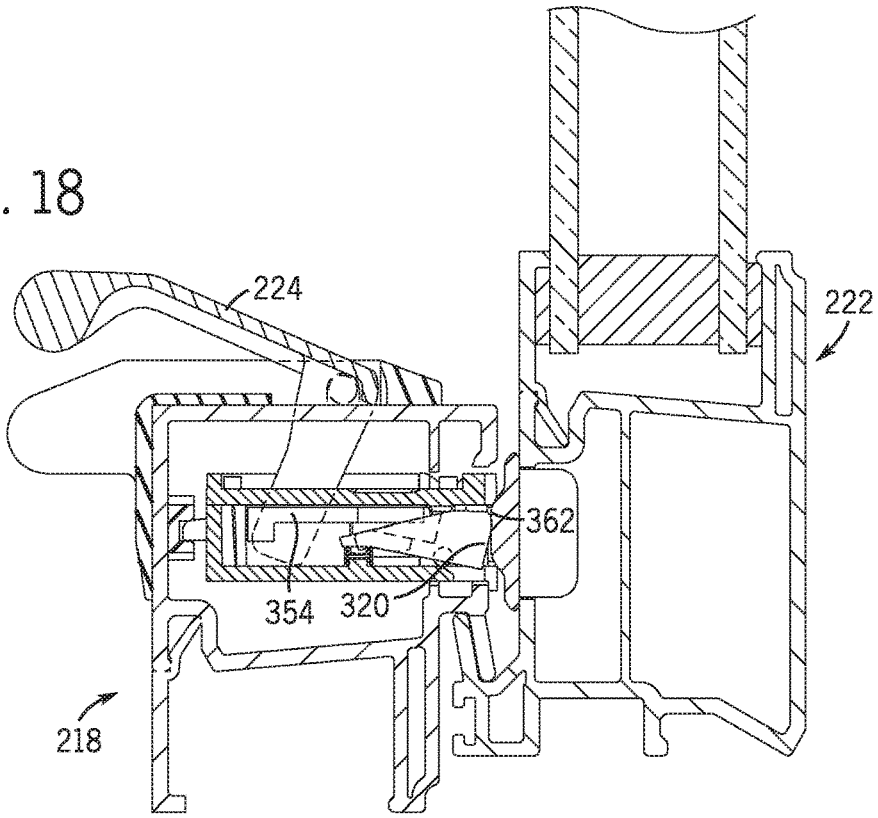
FIG. 18 is a cross-sectional view of the latch and latch plate of FIG. 17 showing the actuator pawl taken generally along lines 17-17 of FIG. 14 when the latch is in the unlocked position.
Figure 19:
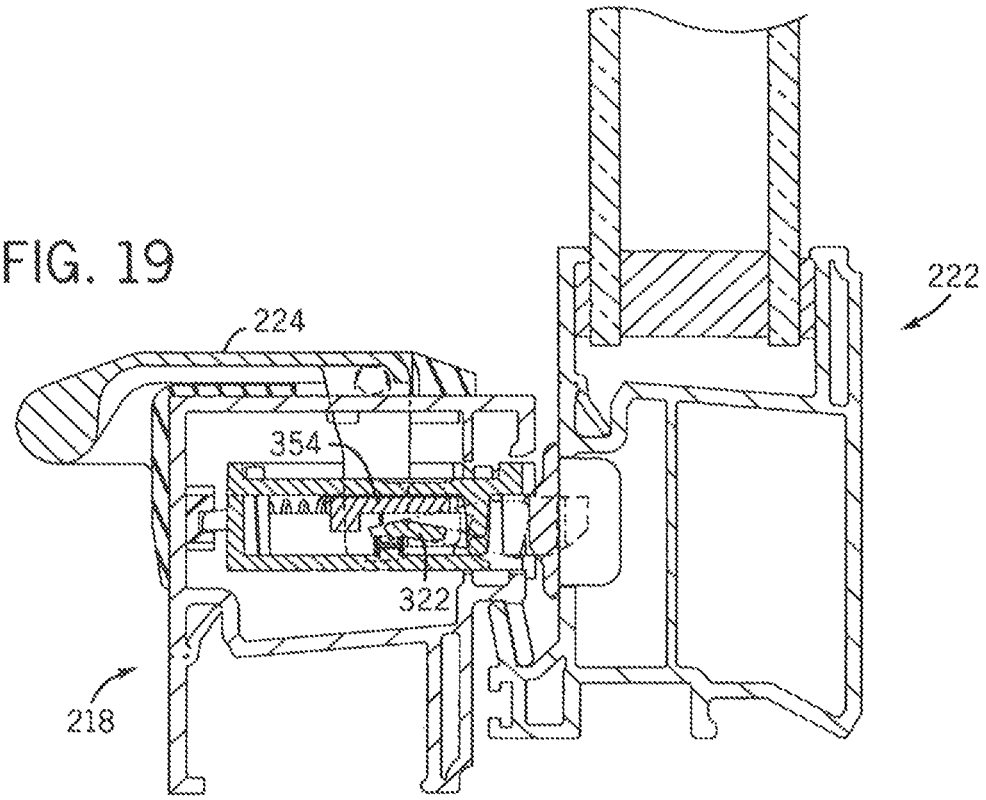
FIG. 19 is a cross-sectional view of the fully assembled latch and latch plate with the latch in a locked position showing the actuator pawl and lockout tab taken generally along lines 19-19 of FIG. 14.

Referring to FIGS. 15-22 the operation of latch 210 will be described. Handle 224, bolt assembly 236, and lock out assembly 234 interact in the operation of the latch to releasably lock first and second sashes 218, 222 together. Referring to FIGS. 15, 17 and 19 handle 224, bolt assemblies 236 and lockout assembly 234 are in fully engaged and locked position. In the locked position the rear portion 334 of bolt housing 328 is located within recessed area 360 in latch plate 214. As a result first sash 218 is locked relative to second sash 222. Bolt spring 366 is received by depression 306 and extends between front wall 296 of base 232 and bolt housing 328. Bolt spring 366 acts to bias bolt housing 328 away from front wall 296 such that the rear portion 334 of the bolt housing 328 extends into recessed area 360 of latch plate 214.

Referring to FIG. 17, in the locked position cam pawl 320 is adjacent the front surface 362 of latch plate 214. As a result the front portion of cam pawl 320 presses against pawl spring 324. Referring to FIG. 19, in the locked position, ramp 322 is located below tab 354 and therefore does not interfere with movement of bolt housing 328.

To unlock the latch a front edge 276 of handle 224 is raised away from first rail 216. Referring to FIG. 16 as handle 224 is raised, arm 282 contacts bolt housing 328 forcing bolt housing 328 toward front wall 296 of base 232. As a result rear portion 334 of bolt housing 218 is retracted from recessed area 360. As arm 282 is pivoted toward the front wall 296 of base 232, handle spring 350 biases shuttle 344 against the rear face 370 of arm 282. When bolt housing 328 is retracted, latch mechanism 210 is unlocked. However, as long as first sash 218 is in a closed position relative to second sash 222, such that bolt assembly 236 is in alignment with recessed area 360, bolt springs 366 will bias bolt housing 328 into the locked position when a user releases handle 224.

Figure 20:
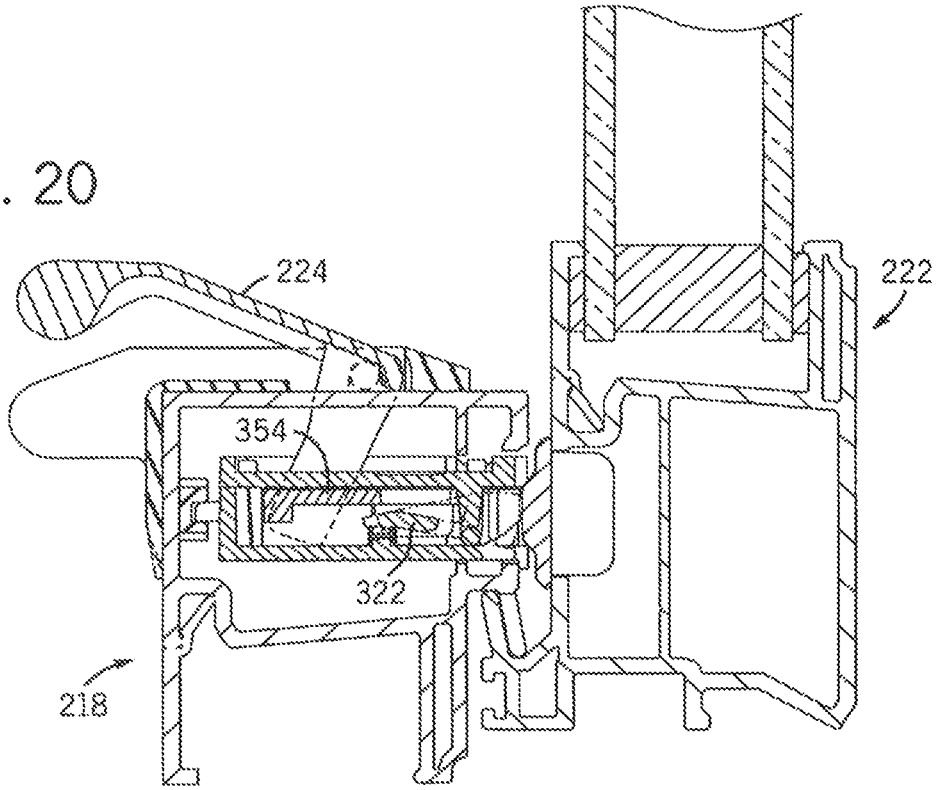
FIG. 20 is a cross-sectional view of the fully assembled latch and latch plate of FIG. 19 showing the actuator pawl and lockout tab when the latch is in the unlocked position.
Figure 21:
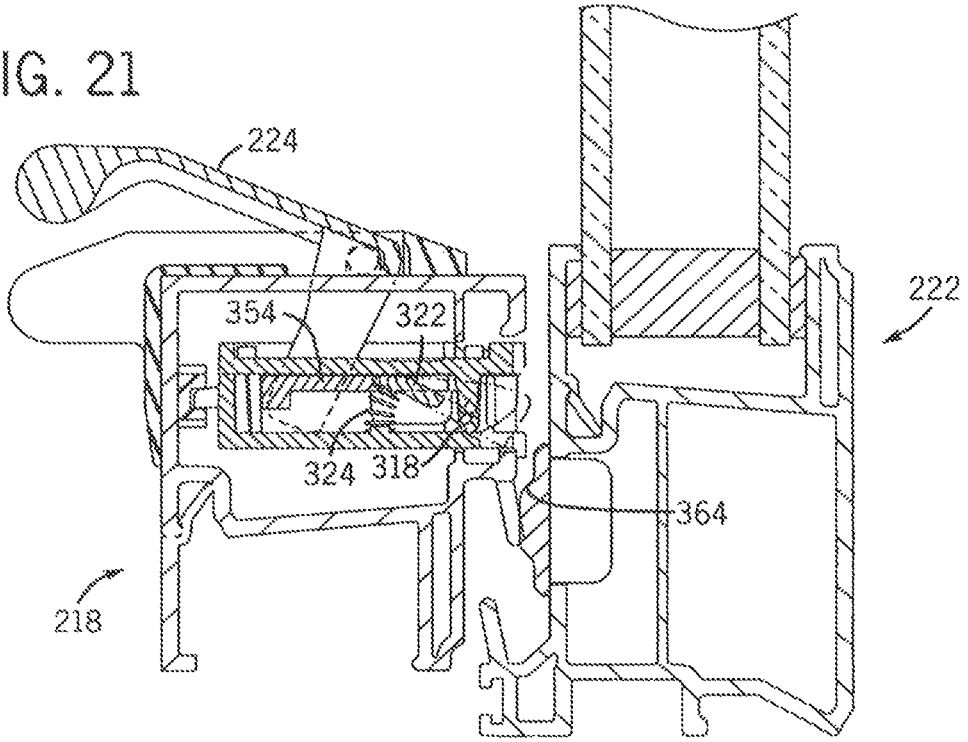
FIG. 21 is a cross-sectional view of the fully assembled latch and latch plate of FIG. 19 showing the actuator pawl and lockout tab when the sash is in an open position and the latch is moved away from the latch plate.

Referring to FIGS. 18 and 20, as long as first sash 218 remains fully closed relative to second sash 222, when a user releases handle 224 it will return to the locked position where top surface 270 of handle 224 is substantially flush with top surface 246 of bezel frame 226. Since the spring force of bolt spring 366 is greater than the spring force of handle spring 350, when handle 224 is released by the user while in the unlocked and closed position then handle 224 will return to being flush with bezel frame 226. Once handle 224 is released while sashes 218 and 222 are in a closed position, latch 212 will lock. Referring to FIG. 21, once a user has raised handle 224, thereby unlocking latch 212, and moves first sash 218 upward toward an open position, pawl 320 clears latch plate 214. Once pawl 320 clears latch plate 214, pawl 320 will be biased about pivot 318 by pawl spring 324. In this position, ramp 322 extends upward and falls within the path of tab 354 of bolt housing 328, prohibiting bolt housing 328 from being biased toward a fully extended and locked position.

Figure 22:
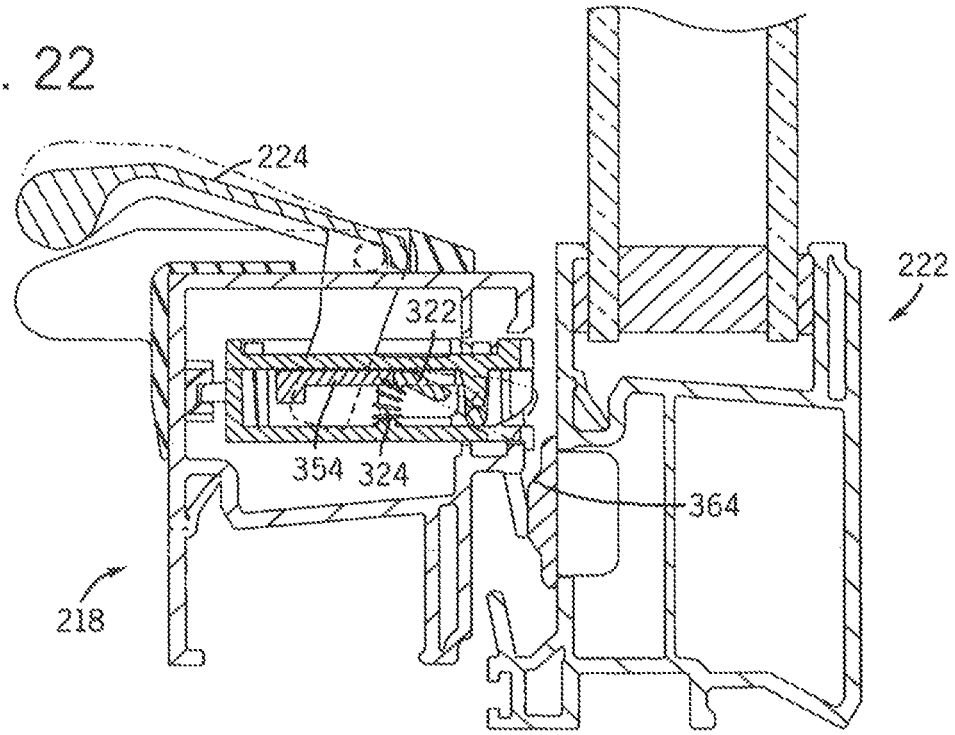
FIG. 22 is a cross-sectional view of the fully assembled latch and latch plate of FIG. 19 showing the actuator pawl and lockout tab when the sash is in the open position and the handle is in a partially raised position.

Referring to FIG. 22, as handle 224 is released, bolt housing 328 moves rearward under the spring force of bolt springs 366. Bolt housing 328 moves rearward until lock tab 354 is stopped by ramp 322. When first sash 218 is open and handle 224 is released, rear portion 334 of bolt housing 328 may extend beyond rear wall 298 of base 232. It is also possible to design the location of ramps 322 to prohibit bolt housing 328 from extending beyond rear wall 298. In this open and released position, handle 224 is closer to top surface 238 of first rail 216 than when handle 224 is fully raised. Handle 224 does not fall back completely within bezel frame 226 under its own weight as a result of the spring force of handle spring 350 pushing against handle 224. In this open and released position, handle 224 remains partially raised when the first sash 218 is open relative to the second sash 222.

Figure 23:
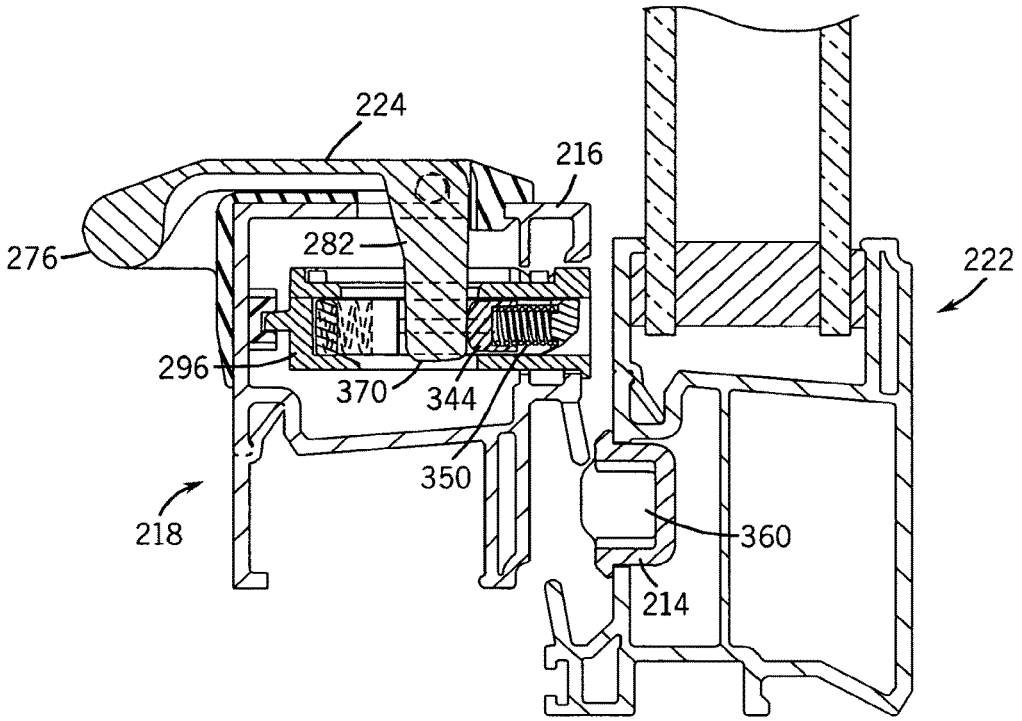
FIG. 23 is a cross-sectional view of the latch and latch plate of FIG. 15 in an unlocked position with the handle forced into a closed position.

As shown in FIG. 23, a user may force handle 224 to its lowered position when the window is open and unlocked by providing sufficient force to overcome the spring force of spring 350. However, upon release of the force by the user, handle 224 will return to the at least partially raised position under the spring force of spring 350. This assures that even if a user inadvertently attempts to force handle 224 to the lowered position while window sash 218 is opened, bolt housings 328 will not move to the engaged position and handle 224 will return to the at least partially raised position to provide a visual indicator that the window is not locked.

When a user closes the window by sliding first sash 218 back to the closed position, the top leading edge of pawl 320 contacts strike portion 364 of latch plate 214. As a result, lockout assembly 234 rotates about pivots 318 releasing ramp 322 from the back edge of lock tab 354. Once lock tab 354 is no longer constrained by ramp 322 of lockout assembly 234, bolt housing 328 is biased rearward by bolt spring 366. Bolt housing 328 is biased rearward such that the rear portion 334 of bolt housing 328 is located within recessed area 360 of latch plate 214. As bolt housing 328 is moved rearward, handle 224 is biased to the closed flush position by bolt housing 328, thereby indicating that latch 210 is in a locked configuration. If bolt housing 328 does not properly align with recessed area 360 of latch plate 214, a rear portion 334 of each bolt housing 328 includes a beveled portion 336 will contact latch plate 214 as first sash 218 is being moved to a closed position relative to second sash 222. As beveled portion 336 contacts latch plate 214, bolt housing 328 is slid toward the front of the base 232 until rear portion 334 of bolt housing 328 clears front surface 362 and enters into recessed area 360 of latch plate 214. In the preferred embodiment, lockout assembly 234 does not release bolt housings 328 until rear portion 334 of bolt housing 328 is aligned with recessed area 360.

It is important to note that the construction and arrangement of the latch mechanism as described herein is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A window and latch comprising:

a sliding sash;

a latch plate having a strike portion;

a housing secured to the sliding sash, the housing including an engagement element, the engagement element movable from a locked position operatively engaged with the latch plate to an unlocked position disengaged from the latch plate; and a handle operatively coupled to the engagement element and being movable from a first position to a second position, the handle operatively moving the engagement element from the locked position to the unlocked position as the handle is moved from the first position toward the second position;

wherein the handle is biased toward the first position only when the sliding sash is in a closed position; and wherein the handle is biased toward and retained in the second position only when the sliding sash is in an open position;

wherein the engagement element is biased to the locked position by a first biasing member spring, the engagement element automatically moves from the unlocked position to the locked position when the sliding sash is moved to the closed position, the handle being operatively biased to the first position as the engagement element moves from the unlocked to the locked position;

a lock out stop assembly having a lock out stop portion, a leading portion, and a lock spring biasing the lock out stop portion into engagement with the engagement element;

the engagement element being positively engaged in the unlocked position by the lock out stop portion when both the sliding sash is in the open position and the handle is moved to the second position, when the sliding sash is in the closed position, the handle automatically returns to the first position, and the lockout stop portion disengages from the engagement element by contact of the leading portion of the lock out assembly with the strike portion of latch plate such that the engagement element moves to the locked position;

wherein the latch plate is secured to a second sash, the handle having a front portion and a rear portion, the rear portion being closer to a plane defined by a glazing of the second sash than the front portion, the handle pivoting about a pivot line proximate its rear portion as the handle is moved from the first position to the second position;

wherein the handle is movable independently from the engagement element from the second position toward the first position upon application of a force to the handle when the sliding sash is in the open position, and wherein the handle is configured to automatically return to the second position when the application of the force is removed and while the sliding sash is in the open position.

2. The window and latch of claim 1, wherein the engagement element includes a channel formed therein, the channel including a first wall and an opposing second wall, the first spring being located within the channel between the first wall and the second wall.

3. The window and latch of claim 1, wherein the sliding sash includes a rail having a first surface defining a plane that extends substantially perpendicular to a glazing of the sliding sash, the handle having a first portion extending between the rear portion of the handle and the front portion of the handle, the first portion of the handle being substantially perpendicular to the glazing of the sliding sash when the handle is in the first position.

4. The window and latch of claim 3, wherein the rail further includes a ledge extending from the first surface of the rail in a direction that extends away from the glazing and in a direction opposite the movement of the sliding sash from the closed position to the open position, the front portion of the handle extending from the first portion of the handle in the same direction as the ledge, the handle pivoting about the pivot line and relative to the rail at a position distal the front portion of the handle.

5. The window and latch of claim 4, wherein the front portion of the handle extends between a first portion and a second portion of the rail ledge.

6. The window and latch of claim 5, further including a bezel frame located on an exterior portion of the first rail and connected to the housing, the handle being pivotally attached to the bezel frame at the rear portion of the handle, the handle having a portion extending through a plane defined by the upper surface of the rail through an opening in the bezel frame.

7. The window and latch of claim 1, wherein the engagement element includes at least two separate elements that move independent of one another.

8. The window and latch of claim 7, wherein the housing guides the at least two engagement elements to move in a linear path between the locked and unlocked positions.

9. The window and latch of claim 1 wherein, a pivot plane is defined as the plane perpendicular to a plane of a glazing of the sliding sash that extends through a longitudinal axis of the pivot line, when the sliding sash is in the closed position, a majority of the handle is positioned a distance from the pivot plane in a direction of movement of the sliding sash from the closed position to the open position.

10. The window and latch of claim 1, wherein the engagement element is biased by the first biasing member spring toward the latch plate when the engagement element is in the unlocked position and the sliding sash is in the open position.

11. A window and latch comprising:

a sliding sash including a rail having an upper surface;

a latch plate;

a housing secured to the sliding sash, the housing including an engagement element, the engagement element movable from a locked position operatively engaged with the latch plate to an unlocked position disengaged from the latch plate;

a second sash, the sliding sash being movable relative to the second sash between a fully closed position and a fully open position; and a handle operatively coupled to the engagement element and being movable from a first position to a second position in the same direction the sliding sash moves to the fully open position from the fully closed position, the handle operatively moving the engagement element from the locked position to the unlocked position as the handle is moved from the first position toward the second position, the handle being operatively pivoted to the sliding sash, a majority of the handle being closer to a plane defined by a glazing of the second sash in the second position than in the first position;

the handle being biased toward the first position only when the sliding sash is in the fully closed position; and the handle being biased toward and retained in the second position by a biasing element when the sliding sash is in the fully open position.

12. The window and latch of claim 11, wherein the rail includes a first portion substantially perpendicular to a glazing of the sliding sash, the rail includes a ledge that extends from the first portion in a direction generally away from the movement of the sliding sash from the fully closed position to the fully open position, a first portion of the handle extending in the same direction as the ledge, the handle pivoting relative to the rail at a position distal a front portion of the handle, wherein the first portion of the handle is intermediate the plane defined by the glazing of the second sash and the front portion of the handle when the handle is in the first position, wherein the handle pivots about a pivot line positioned between the plane defined by the glazing of the second sash and the front portion of the handle.

13. The window and latch of claim 12, further including a bezel frame located on an exterior portion of the first rail and connected to the housing, the handle being pivotally moved relative to the bezel frame at a rear portion of the handle, the handle having a portion extending into the upper surface of the rail through an opening in the bezel frame.

14. The window and latch of claim 13, wherein the first portion of the handle between the rear portion of the handle and the front portion of the handle is no more than 0.250 inches from the first portion of the rail.

15. The window and latch of claim 14, wherein the front portion of the handle is located between a first portion and a second portion of the ledge.

16. The window and latch of claim 11, wherein the handle includes an outer surface and an inner surface, the inner surface being closer to the rail than the outer surface, wherein a majority of the outer surface is closer to the plane defined by the glazing of the second sash in the second position than in the first position.

17. The window and latch of claim 11, wherein the handle includes an outer surface and an inner surface, the inner surface being closer to the rail than the outer surface, wherein a majority of the outer surface is closer to the plane defined by the glazing of the second sash along a direction perpendicular to the plane defined by the glazing of the second sash in the first position than in the second position.

18. The window and latch of claim 11 wherein the handle pivots relative to the rail proximate a rear edge of the handle, wherein the rear edge of the handle is closer to the plane defined by the glazing of the second sash along a direction perpendicular to the plane defined by the glazing of the second sash than a front edge of the handle upon which a force is directly applied to pivot the handle relative to the sliding sash.

19. The window and latch of claim 11, wherein the majority of the handle includes a portion of the handle distal a pivot portion of the handle.

20. A window and latch comprising:

a sliding sash and a second sash, the sliding sash having a rail including a housing provided with an engagement element releasably movable within the housing from an extended locked position engaging a latch plate, to a retracted unlocked position disengaged from the latch plate;

the rail including an upper surface extending perpendicular to a sliding sash plane defined by a glazing of the sliding sash, a second surface extending parallel to the sliding sash plane, and a ledge portion extending beyond the second surface in a direction away from the sliding sash plane;

a handle having an upper surface and a free end, the handle is operatively coupled to the engagement element and is attached to the sliding sash, a majority of the handle including the free end being movable in a first direction from a first lowered position to a second raised position, a vector of movement of the handle in the first direction has a first component corresponding to a direction in which the sliding sash moves to an open position from a closed position and a second component corresponding to a direction perpendicular to and extending toward the sliding sash plane, a portion of the free end of the handle and a portion of the ledge of the rail are in a plane being substantially perpendicular to the sliding sash plane when the handle is in the first lowered position;

wherein the handle is operatively held in the second raised position only when the engagement element is in the retracted unlocked position and the housing is offset from the latch plate in the first direction; and wherein the handle is operatively held in the first lowered position when the engagement element is in the extended locked position.

21. The window and latch of claim 20 wherein the portion of the free end of the handle and the portion of the ledge are substantially co-linear.

22. The window and latch of claim 20 wherein the distance a majority of the handle moves as the handle moves from the first lowered position to the second raised position is greater along the first component than the second component.

* * * * *